United States Patent [19]

Dixon et al.

[11] Patent Number: 4,633,954

[45] Date of Patent: Jan. 6, 1987

[54] WELL PRODUCTION CONTROLLER SYSTEM

[75] Inventors: Glen A. Dixon, The Colony, Tex.; Clark E. McCloskey, Yukon, Okla.; David L. Chambers; Woodrow D. Hawk, both of Garland, Tex.; Oliver W. McCracken, Pauls Valley, Okla.

[73] Assignee: Otis Engineering Corporation, Dallas, Tex.

[21] Appl. No.: 557,950

[22] Filed: Dec. 5, 1983

[51] Int. Cl.[4] ..... E21B 34/16

[52] U.S. Cl. ..... 166/372; 166/53; 166/64; 166/263; 137/624.2

[58] Field of Search ..... 166/53, 64, 66, 372, 166/263; 73/61.1 R; 137/624.2

[56] References Cited

U.S. PATENT DOCUMENTS

| | | | |
|---|---|---|---|
| 4,150,721 | 4/1979 | Norwood | 166/53 |
| 4,211,279 | 7/1980 | Isaacks | 166/372 |
| 4,267,885 | 5/1981 | Sanderford | 166/53 |
| 4,275,790 | 6/1981 | Abercrombie | 166/53 |
| 4,352,376 | 10/1982 | Norwood | 166/53 |
| 4,375,833 | 3/1983 | Meadows | 137/624.2 |
| 4,410,038 | 10/1983 | Drapp | 166/53 |
| 4,429,273 | 1/1984 | Mazzagatti | 73/61.1 R |

*Primary Examiner*—Stephen J. Novosad
*Assistant Examiner*—Bruce Kisliuk
*Attorney, Agent, or Firm*—H. Mathews Garland

[57] ABSTRACT

A fully programmable system for controlling the operation of one or more gas or oil production wells by controlling the intermittent operation of the wells in response to either programmed information or monitored and measured criteria related to the wells themselves. The system includes battery powered solid state circuitry comprising a keyboard, a programmable memory, a microprocessor, control circuitry, means for inputting measured parameters from a plurality of transducers and a liquid crystal display system for displaying information contained within the memory, or one of the measured parameters. In one embodiment, the system monitors pressure, flow, and other parameters of a plurality of wells drawing petroleum products from a common reservoir to control the intermittent operation of either gas injection to the well, outflow of fluids from the well, or shutting in of the well to maximize the overall output of the entire array of wells drawing from the common reservoir.

40 Claims, 13 Drawing Figures

WELL PRODUCTION CONTROLLER SYSTEM

BACKGROUND OF THE INVENTION

1. Field of the Invention

The present invention relates to a system for electronically controlling one or more petroleum production wells, and more particularly, to a system for controlling wells in order to optimize the production efficiency of formation fluids.

2. History of the Prior Art

Each underground hydrocarbon producing formation, known as a reservoir, has its own characteristics with respect to permeability, porosity, pressure, temperature, hydrocarbon density and relative mixture of gas, oil and water within the formation. In addition, various subterranean formations comprising a reservoir are interconnected with one another in an individual and distinct fashion so that the production of hydrocarbon fluids at a certain rate from one area of one formation will affect the pressures and flows from a different area of an adjacent formation.

Certain general characteristics are, however, common to most oil and gas wells. For example, during the life of any producing well, the natural reservoir pressure decreases as gases and liquids are removed from the formation. As the natural downhole pressure of a gas well decreases, the well bore tends to fill up with liquids, such as oil and water, which block the flow of the formation gas into the borehole and reduce the output production of the well. In such gas wells, it is conventional to periodically remove the accummulated liquids by artificial lift techniques which include plunger lift devices, gas lift devices and downhole pumps. In the case of oil wells within which the natural pressure has decreased to the point that oil does not spontaneously flow to the surface, fluid production is maintained by artificial lift methods such as downhole pumps and by gas injection lift techniques. In addition, certain wells are frequently stimulated into increased production by secondary recovery techniques such as the injection of water and/or gas into the formation to maintain reservoir pressure and to cause a flow of fluids from the formation into the wellbore.

In oil and gas wells wherein the ambient reservoir pressure has been substantially depleted, two general techniques are commonly used: (1) plunger lift and (2) gas lift.

Plunger lift production systems include the use of a small cylindrical plunger which travels through tubing extending from a location adjacent the producing formation down in the borehole to surface equipment located at the open end of the borehole. In general, fluids which collect in the borehole and inhibit the flow of fluids out of the formation and into the wellbore, are collected in the tubing. Periodically the end of the tubing is opened at the surface and the accumulated reservoir pressure is sufficient to force the plunger up the tubing. The plunger carries with it to the surface a load of accummulated fluids which are ejected out the top of the well thereby allowing gas to flow more freely from the formation into the wellbore and be delivered to a distribution system at the surface. After the flow of gas has again become restricted due to the further accummulation of fluids downhole, a valve in the tubing at the surface of the well is closed so that the plunger then falls back down the tubing and is ready to lift another load of fluids to the surface upon the reopening of the valve.

A gas lift production system includes a valve system for controlling the injection of pressurized gas from a source external to the well, such as another gas well or a compressor, into the borehole. The increased pressure from the injected gas forces accumulated formation fluids up a central tubing extending along the borehole to remove the fluids and restore the free flow of gas and/or oil from the formation into the well. In wells where liquid fall back is a problem during gas lift, plunger lift may be combined with gas lift to improve efficiency. Such a system is shown in U.S. Pat. No. 4,211,279 issued July 9, 1980 to Kenneth M. Isaaks.

In either case, there is a requirement for the periodic operation of a motor valve at the surface of the wellhead to control either the flow of fluids from the well or the flow of injection gas into the well to assist in the production of gas and liquids from the well. These motor valves are conventionally controlled by timing mechanisms and are programmed in accordance with principles of reservoir engineering which determined the length of time that a well should be either "shut in" and restricted from flowing gas or liquids to the surface and the time the well should be "opened" to freely produce. Generally, the criteria used for operation of the motor valve is strictly one of the elapse of a preselected time period. In most cases, measured well parameters, such as pressure, temperature, etc. are used only to override the timing cycle in special conditions.

For example, U.S. Pat. No. 4,354,524 discloses a pneumatic timing system which improves the efficiency of using injected gas to artifically lift liquids to a well surface by means of the plunger lift technique. U.S. Pat. No. 3,336,945 to Bostock et al discloses a pneumatic timing device for timing the intermittent operation and/or injection of wells to increase the production. U.S. Pat. No. 4,355,365 to McCracken et al discloses a system for electronically intermitting the operation of a well in accordance with prior art timing techniques wherein the well is allowed to flow for a first preselected period and then shut in for a second preselected period to increase the production from the well. The differential control system manufactured by Plunger Lift Systems, Inc. of Marietta, Ohio serves to operate a plunger lift completion in accordance with a gating system in which measured values of pressure and fluid levels are compared with pre-set values. U.S. Pat. No. 4,150,721 to Norwood discloses a similar gas well controller system which also utilizes digital logic circuitry gating to operate a well in response to a timing counter and certain measured well parameters.

Under certain circumstances, however, the mere timed intermittent operation of a single motor valve to control either outflow from the well or gas injection to the well will not effect maximum production nor will operation based upon a mechanical comparison of well parameters with preset maximum and minimum values. It is inefficient and costly to inject gas into a wellbore which does not contain liquids which require artificial lift or when the well is flowing naturally with a satisfactory production rate. Further, it is inefficient to inject either too small or too large a volume of gas as compared to the volume of liquid contained within the borehole which does, in fact, need artificial lift. For example, it may be desirable to open a well flow valve and a gas inject valve simultaneously and then close the gas inject valve after a first time period when sufficient pressure is developed in the well to produce continued flow from the well for a second time period. In addition, sequential operation of a pair of motor valves may be desirable such as when two valves are connected to the well output and a first is opened to allow fluid explusion and then closed while a second valve is simultaneously opened for a time period to allow gas production after the fluid has been cleared. Moreover, it may also be useful to utilize a single controller to sequentially intermit the operation of individual ones of a plurality of wells, each for different selected time periods.

As reservoir engineering technology becomes more sophisticated, more is learned about the various parameters which affect the optimum production of a well, and even the manner in which production from adjacent wells affect each other. It is clear that a system by which a plurality of wells could be controlled for periodic operation to maximize and optimize the production from all wells would be of value. In addition, it would be an advantage to utilize other parameters associated with a producing well, such as casing pressure, tubing pressure, flow rate and pressure and oil/water mix, upon which to base the criteria of when to intermittently open or close a well or when to intermittently inject fluids into the well to stimulate the production of gas and/or liquids therefrom. For example, it would be desirable to open a flowing well when the tubing pressure is greater than an ideal value determined from casing pressure, flowing pressure and gas/liquid ratio.

Moreover, it would be highly desirable to be able to provide a fully programmable controller for the operation of a plurality of motor valves within an array of producing wells whereby various measured parameters from each of the wells could be used to control the intermittent operation of each of those wells in order to optimize the production from all of the wells. The system of the present invention provides such a fully programmable controller for the optimization of well production.

The system of the present invention can be used in multiple applications of producing wells, for example, in gas lift completions, plunger lift completions, wells having fluctuating bottom hole pressures and production flow rate and, in addition, to unload gas wells. In particular, the present invention is especially useful in any type of artificial lift completion which involves the intermittent injection of gas in order to lift liquids to the surface and may also be used to control gas injection into one or more wells in order to optimize the total production of formation fluids from the wells.

SUMMARY OF THE INVENTION

An object of the present invention is to provide an electronic controller which measures various well parameters, analyzes those measurements based upon preprogrammed considerations, and controls the intermittent injection of gas into one or more wells to provide for optimum gas/liquid ratio and optimum production rates from the well or wells.

Another object of the present invention is to provide a system which includes motor valves, parameter sensing equipment, and a programmable electronic controller which continually adjusts the opening and closing of the motor valves for optimum formation fluid production rates. In addition, another object includes providing a system which monitors injection supply gas pressure, motor valve position, wellhead production fluid pressure, wellhead production fluid temperature, wellhead production flow rate, gas to liquid ratio, sales flow line pressure, sales flow line temperature, sales line flow rate, and plunger position for all wells producing within a system and which controls the gas injection and/or production flow from each of the wells to optimize production from all of the wells.

A still further object of the present invention is to provide a system in a gas injection lift production system which measures the results of each injection of gas such as the arrival of a plunger at the well surface, the increase in liquid production, and the increase in casing pressure and modifies the injection intervals to maximize production from the well. Another object is to provide a system which will terminate gas injection into a well if gas supply pressure drops too low, if casing pressure increases to too high a value, if plunger arrival does not occur within a calculated maximum time interval, or if production flow line pressure increases to too high a value.

A further object of the present invention is to provide an electronic controller for a oil/gas production system which is fully programmable and has a display panel which allows periodic re-programming thereof.

One further embodiment of the present invention includes a production controlling system having provision for monitoring tubing, casing, and production flow line pressures for optimum control of production from plunger lift wells. An additional object is to provide an electronic controller which monitors tubing, casing and production line flow pressures to adjust the on/off time for production from the well based upon a comparison of actual tubing pressure with a calculated ideal tubing pressure and to shut in the well upon arrival of the plunger at the well surface, or casing pressure dipping below a pre-selected limit or exceeding a pre-selected maximum time limit for production from the well.

A further object of the invention is to sequentially intermit the operation of individual ones of a plurality of different wells, each for different time periods.

An additional object of the invention is to simultaneously open a pair of motor valves and then close them sequentially after different time periods to increase production for a given quantity of injection gas. A further object is to sequentially open a first motor valve to allow liquid expulsion and close it thereafter while simultaneously opening a second valve to allow gas production for a selected time period.

BRIEF DESCRIPTION OF THE DRAWING

For understanding of the present invention and for further objects and advantages thereof, reference may now be had to the following description taken in conjunction with the accompanying drawing in which.

DESCRIPTION OF THE PREFERRED EMBODIMENT

Dual Controller Operation

Figure 2:
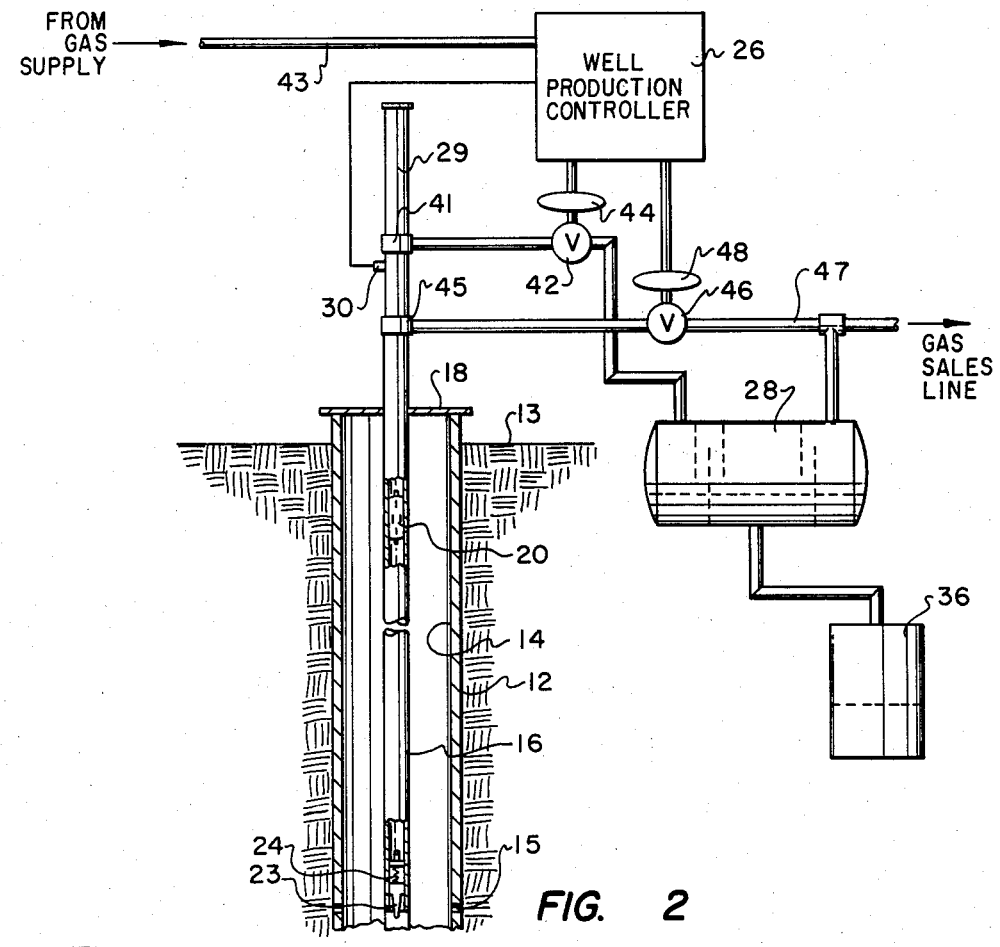
FIG. 2 is a schematic drawing of a plunger lift well completion having two motor valves and including a programmable electronic controller constructed in accordance with the teachings of the present invention.
Figure 1:
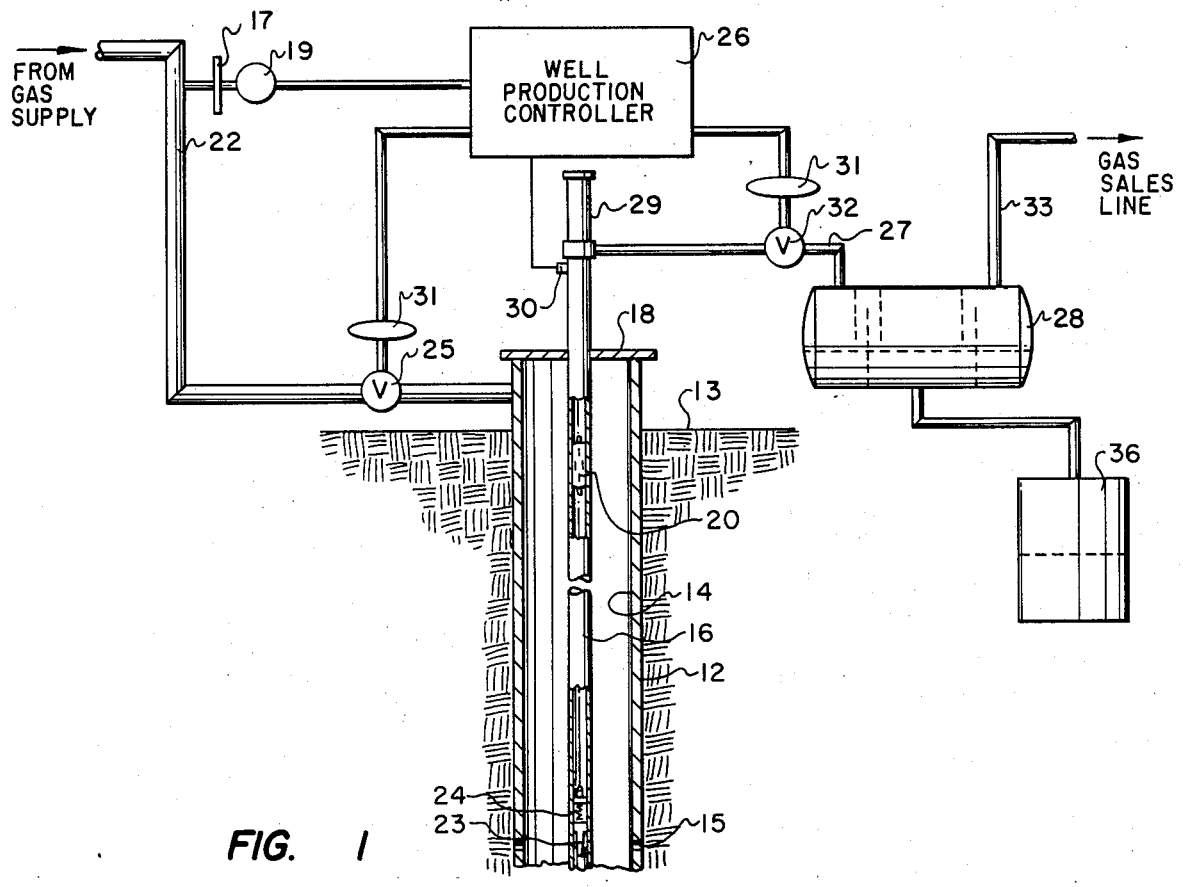
FIG. 1 is a schematic drawing of a gas injection plunger lift well completion having two motor valves and including a programmable electronic controller constructed in accordance with the teachings of the present invention.

The well completions shown in FIGS. 1 and 2 operate with the controller of the present invention in a first mode to simultaneously open a pair of motor valves and sequentially close them in pre-selected time frames and in a second mode to sequentially open a pair of motor valves, simultaneously opening the second and closing the first in accordance with detection of the occurrence of an event and pre-selected time periods.

Mode A

Referring first to FIG. 1, there is shown an illustrative schematic of a gas well equipped as a plunger lift completion with supplementary gas injection. The well includes a borehole 12 extending from the surface of the earth 13 which is lined with a tubular casing 14 which extends from the surface down to the producing geological strata. The casing 14 includes perforations 15 in the region of the producing strata to permit the flow of gas from the formation into the casing lining the borehole. The producing strata into which the borehole and the casing extends is formed of coarse rock and serves as a pressurized reservoir containing a mixture of gas, oil and water. The casing 14 is preferably perforated along the region of the borehole containing the producing strata in area 15 in order to allow fluid communication between the strata and the well. A string of tubing 16 extends axially down the casing 14.

Both the tubing and the casing extend into the borehole from a wellhead 18 located at the surface above the well which provides support for the string of tubing extending into the casing and closes the open end of the casing. The casing is connected to a line 22 which supplies high pressure gas from an external source such as a compressor (not shown) through a first motor valve 25 into the casing 14. The first motor valve 25 is operated between the open and close condition by a programmable well production intermitter/controller 26 constructed in accordance with the teachings of the present invention.

The tubing 16 is connected to a production flow line 27, through a second motor valve 32 and to a separator 28. The output flow of the tubing 16 into the production flow line 27 is generally a mixture of both liquids, such as oil, water, and condensate, and gases and is directed through the separator 28 which effects the physical separation of the liquids from the gases and passes the gas into a sales line 33 for delivery to a gas gathering system. The liquids output from the separator 28 are directed into a liquid storage reservoir 36 for subsequent disposal by well known methods. Pressurized gas is also supplied through a filter 17 and a regulator 19 for use in pneumatically operating the motor valves 25 and 32 by means of solenoids 31.

The string of tubing 16 extends axially down the casing and is terminated by a tubing stop 23 and bumper spring 24. A reciprocating plunger 20 is positioned within the tubing 16 and is prevented passing out the lower end of the tubing by the bumper spring 24 and tubing stop 23. The upper end of the tubing 16 is closed by a lubricator 29 which receives the plunger 20 when it is in its uppermost position. The lubricator 29 also includes a sensor 30 which detects when the plunger has arrived at its uppermost position.

In a gas inject system of the type shown in FIG. 1, it is desirable to conserve gas and inject only as much gas through the first motor valve 25 as is required to move the plunger 20 up the tubing 16 and eject the accumulated fluids from the well through the second motor valve 32. Thereafter, the first valve is closed and the second allowed to remain open for a pre-selected time period of production flow from the cleared well. When the well has been closed for a sufficient period of time to develop a formation pressure, liquids will also have accumulated within the casing 14, in the region of the perforations 15 adjacent the producing formation. These formation fluids restrict the flow of gases from the formation into the casing so they are removed at the beginning of the production cycle when both the first and second motor valves 25 and 32 are opened simultaneously. The first motor valve 25 is opened by means of "on" solenoid 31 to inject a flow of high pressure gas from the external source into the casing 16 and raise the pressure. The second motor valve 32 is opened also by means of an "on" solenoid 31 to open the upper end of the tubing production flow line 27 and cause the plunger 20 to move upwardly within the tubing and bring along with it a quantity of formation fluids which have accumulated within the casing in the region of the producing formation. The liquids brought to the surface by the plunger 20 flow out through the second motor valve 32 and the production flow line 27 into the separator 28 in a conventional fashion. The plunger arrival sensor 30 detects when the plunger 20 has reached the top of the tubing and is lodged in the lubricator 29 and produces a plunger arrival output signal to the controller 26. In response to the plunger arrival signal, or the passage of a pre-programmed time, whichever happens first, the controller 26 operates the "off" solenoid 31 of the first motor valve 25 to close the valve and stop gas injection. The second motor valve 32 is allowed to remain open for a pre-programmed time period to permit the flow of production gas from the formation. After the set time period, the second motor valve 32 is closed to permit the plunger 20 to fall back down the tubing string 16 and reposition itself at the bumper spring 24 for a subsequent trip to the surface to again empty accumulated formation fluids from the well. Thus, in the system of FIG. 1, a pair of motor valves are simultaneously opened and sequentially closed to maximize production flow while minimizing the consumption of injection gas.

Mode B

Referring now to FIG. 2, there is shown an illustrative schematic of a plunger lift completion gas well, similar to the well of FIG. 1, but wherein the formation pressure is sufficient that no supplementary injection gas is necessary in order to clear the well of accumulated fluids. The well includes a borehole 12 extending from the earth surface 13 down to the producing geological strata and which is lined with a tubular casing 14. The casing 14 also includes perforations 15 in the region of the producing strata to permit the flow of gas from the formation into the casing. A string of tubing 16 extends actually down the casing 14.

Both the tubing 16 and the casing 14 extend into the borehole from a wellhead 18 located at the surface and which provides support for the string of tubing and closes the open end of the casing. A reciprocating plunger 20 is positioned within the tubing 16 and is prevented from passing out the lower end of the tubing by a bumper spring 24 and tubing stop 23. The uopper end of the tubing 16 is enclosed by a lubricator 29 which receives the plunger 20 when it is in its uppermost position. The lubricator 29 also includes a sensor 30 which measures when the plunger has arrived at its uppermost position.

The upper end of the tubing 16 is connected to a first flow "T" 41 and a first motor valve 42 into a low pressure fluid delivery line 43 leading to a separator 28. The first motor valve 42 is actuated by a pair of "on" and "off" solenoids 44 under control of a well production controller 26 constructed in accordance with the teachings of the invention. The solenoids control the flow of pressurized air or gas supplied via line 43 by means not shown. The upper end of the tubing 16 is also connected to a second flow "T" 45 through a second motor valve 46 to a high pressure gas sales line 47. The second motor valve 46 is actuated by "on" and "off" solenoids 48 under control of controller 26.

In operation, the plunger lift completion of FIG. 2 is closed in for a pre-selected time period during which sufficient formation and gas pressure is developed to move the plunger 20 along with fluids accumulated in the casing 14 to the surface. After passage of the selected time period, the cycle is begun by opening motor valve 42. As the plunger 20 rises to the surface, the accumulated fluids carried by the plunger pass out through the first flow "T" 41, through the low pressure fluid line 43 into the separator 28. When the plunger arrival sensor 30 detects that the plunger is positioned in the lubricator 29, the controller 26 closes the first motor valve 42 and simultaneously opens the second motor valve 46 to allow the high pressure formation gases to pass through the second flow "T" 45 and out the high pressure gas sales line 47. After a pre-selected time period of high pressure production gas flow through the line 47, the second motor valve 46 is again closed to shut in the well and allow the plunger 20 to drop back down the tubing 16 and the formation gas pressure to re-accumulate for a subsequent cycle.

Thus, in the system of FIG. 2, a pair of motor valves are operated so that a first valve is opened for a time to clear the well and then closed while a second valve is simultaneously opened for a second time period to allow production flow from the cleared well and then closed. Thus, this mode of plural valve operation effectively separates the low pressure fluids from the high pressure production gas.

Figure 5:
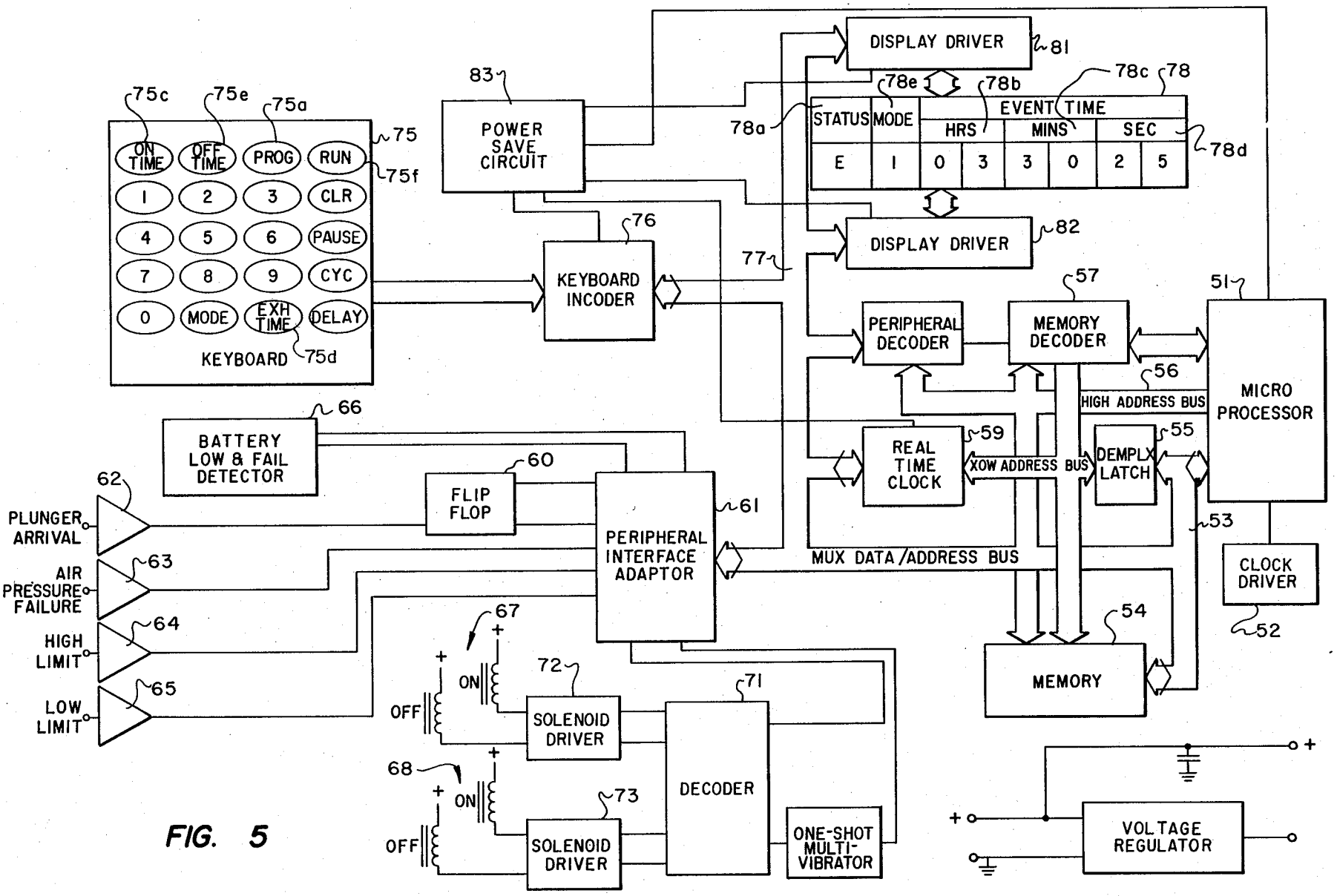
FIG. 5 is a block diagram of an electronic controller used in conjunction with the systems shown in FIGS. 3 and 4.

Referring now to FIG. 5, there is shown a block diagram of the well production controller 26 which effects the operation of the well completions illustrated in FIGS. 1 and 2. The circuitry includes a micro-processor 51 driven by a clock driver 52 and connected via a multiplexed data/address bus 53 to a memory 54 and a demultiplexing latch 55. The processor 51, as well as all other processors referred to herein, is preferably of the CMOS type and, by way of example only, a national semi-conductor model NSC 800N-1 CMOS microprocessor has performed satisfactorily. The microprocessor 51 is also connected through an address bus 56 and a memory decoder 57 to the memory 54 and to a perpheral decoder 58 and a real time clock 59. Finally, the micro-processor 51 is connected over the bus 53 to a peripheral interface adapter (PIA) 61.

The peripheral interface adapter 61 is connected to receive input from a plunger arrival sensor through an operational amplifier 62 and an air pressure fail sensor through an associated amplifier 63. A high tubing pressure limit sensor provides a signal through amplifier 64 in the event the tubing pressure exceeds a pre-selected value while a low tubing pressure sensor provides a signal through amplifier 65 in the event the tubing pressure drops below a pre-selected value. In addition, since only battery power is available in the remote areas where such systems are most often located, the system is provided with a low battery voltage detector and a battery voltage failure detector 46 which provides information through the peripheral interface adapter 61 to the rest of the system.

The peripheral interface adapter 61 is connected to actuate a pair of motor valves by means of two pairs of solenoids, one for "on" and one for "off" in each of the solenoid pairs 67 and 68. An address from the peripheral interface adapter 61 is passed through a decoder 71 to one or the other of a pair of solenoid drivers 72 and 73 for respective ones of the motor valve solenoid pairs 67 and 68. A one shot multi-vibrator 74 selects the time period during which a signal is supplied to the solenoid drivers. The well controller system of FIG. 5 also includes a keyboard 75 for the entry of multiple programming data into the memory 54 through a keyboard encoder 76 and the bus system 77.

A multi-character optical display 78, preferably of the liquid crystal display (LCD) type, is provided for operator observation of information as it is programmed into the system as well as various parameters and items of data which can be monitored during the operation of the system. In addition, the display provides a visual alarm upon malfunction as well as visual indications of low battery voltage and a battery failure condition. The display 78 is driven through a pair of display drivers 81 and 82 in conventional fashion. In one embodiment of the display 78, each character can be either the numerals 0–9 or the letters H, E, L, or P. A loss of solenoid air supply pressure effects closure of all motor valves and is visually indicated by the indication HELP 1; a low battery alarm is indicated by a display which alternately flashes HELP 2 and the time at which the condition began; a dead battery effects closure of all motor valves and is shown by HELP 3. The status portion of the display 78*a* indicates the condition of the cycle of operation of the circuit as either ON TIME-P; OFF TIME-E; or EXHAUST TIME-L while the remaining time is shown and decremented in hours, minutes and seconds in display sections 78*b*, 78*c*, and 78*d*, respectively. The mode of operation of the controller is shown in Section 78*e*: 1 to mode A and 2 for mode B.

To provide maximum battery life in remote locations, the system includes a power save circuit 83 which operates to power down all processor functions except those necessary to maintain memory until the occurrence of either the passage of a selected time period or the receipt of an input signal from the keyboard 75.

In the operation of the system of FIG. 5 in mode A, as described above in connection with FIG. 1, programming entries are made by first depressing the MODE key 75*b* and thereafter either the numeral 1 to select MODE A and the numeral 2 to select MODE B. For example, to programm a MODE A operation, the PROGRAM key 75*a* is then depressed followed by the ON TIME key 75*c* and then numeral keys to program into the memory 54 a time indicative of the time period within which gas is to be injected into the well with both motor valves open. Next, the PROGRAM KEY 75*a* is pressed again followed by the EXHAUST TIME key 75*d* and numeral keys to enter into memory the time during which the second motor valve is to remain open after the first valve is closed so that production flow from the well may continue. Finally, the PROGRAM key 75*a*, OFF TIME key 75*e* and numeral keys are sequentially activated and a third time is entered into memory which is indicative of the time within which both motor valves should be closed and the well shut-in. Each of the programming parameters are displaced in the LCD display 78 as they are entered into memory through keyboard 75. A mode B operation is similarly programmed with ON TIME to open the first motor valve (a "maximum time" in the event the plunger does not arrive by then), EXHAUST TIME to close the first motor valve and open the second and OFF TIME to close the second motor valve and shut-in the well.

Once the system is started by depressing RUN key 75*f*, the micro-processor 51 controls operation of the system to provide signals to the peripheral interface adapter 61, decoder 71, and one-shot multi-vibrator 74 to energize both the solenoid drivers 72 and 73 and open both motor valves 67 and 68. After the first "one" time period has elapsed, the first motor valve 67 is closed to stop the injection of lift gas into the well while the second motor valve 68 remains open to allow production flow from the well for an additional "exhaust time" after which a signal is provided to the peripheral interface adapter 61 to effect the closure of the second motor valve 68. Thereafter, both valves remain closed for a third pre-selected "off time" period until the cycle is begun again.

In the operation of the circuitry of FIG. 5 in mode B, in connection with the operation of the completion shown in FIG. 2, the keyboard 75 is used to select PROGRAM, MODE and the numeral 2 and, thereafter, program the "on" time period within which high pressure gas production flow is to occur following clearing of the well as well as the time within which the well is to be fully shut in to allow formation pressure to accumulate. Upon initiation of the cycle by depression of the RUN key 75*f*, the microprocessor delivers a signal through the peripheral interface adapter 61, the one-shot multi-vibrator 74, and the decoder 71 to open the first motor valve 67. When a signal is received over the plunger arrival sensor through the operation amplifier 62, the flip-flop 60 and the peripheral interface adapter 61, the micro-processor again causes the first motor valve 67 to close and, simultaneously, the second motor valve 68 to open for a pre-selected "exhaust time" period of high pressure production flow. Thereafter, both motor valves 67 and 68 are closed for a pre-programmed "off time" period and the cycle is again repeated.

The system also includes a "pressure override" feature in both modes A and B so the pressure transducers are connected through operational amplifiers 64 and 65 so that after an on time has expired and the tubing pressure is still above a pre-set high limit, the well will remain open until the pressure fails below that value. Similarly, if after an off time has expired, the tubing pressure is still below a lower limit the well stays closed.

Figure 7A:
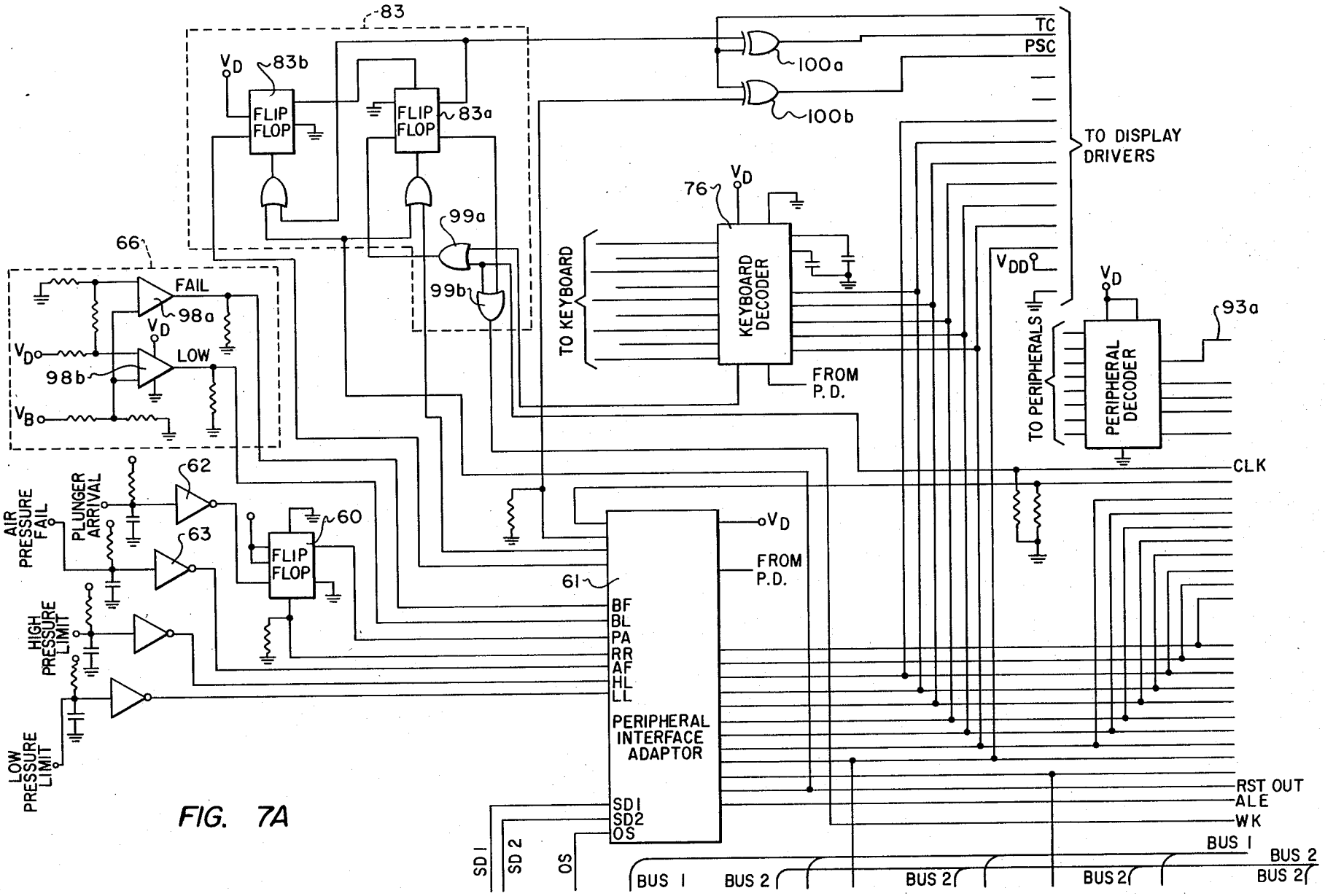
FIGS. 7A, 7B and 7C are each portions of a schematic diagram of an electronic controller constructed in accordance with the invention and shown in FIG. 5.
Figure 7B:
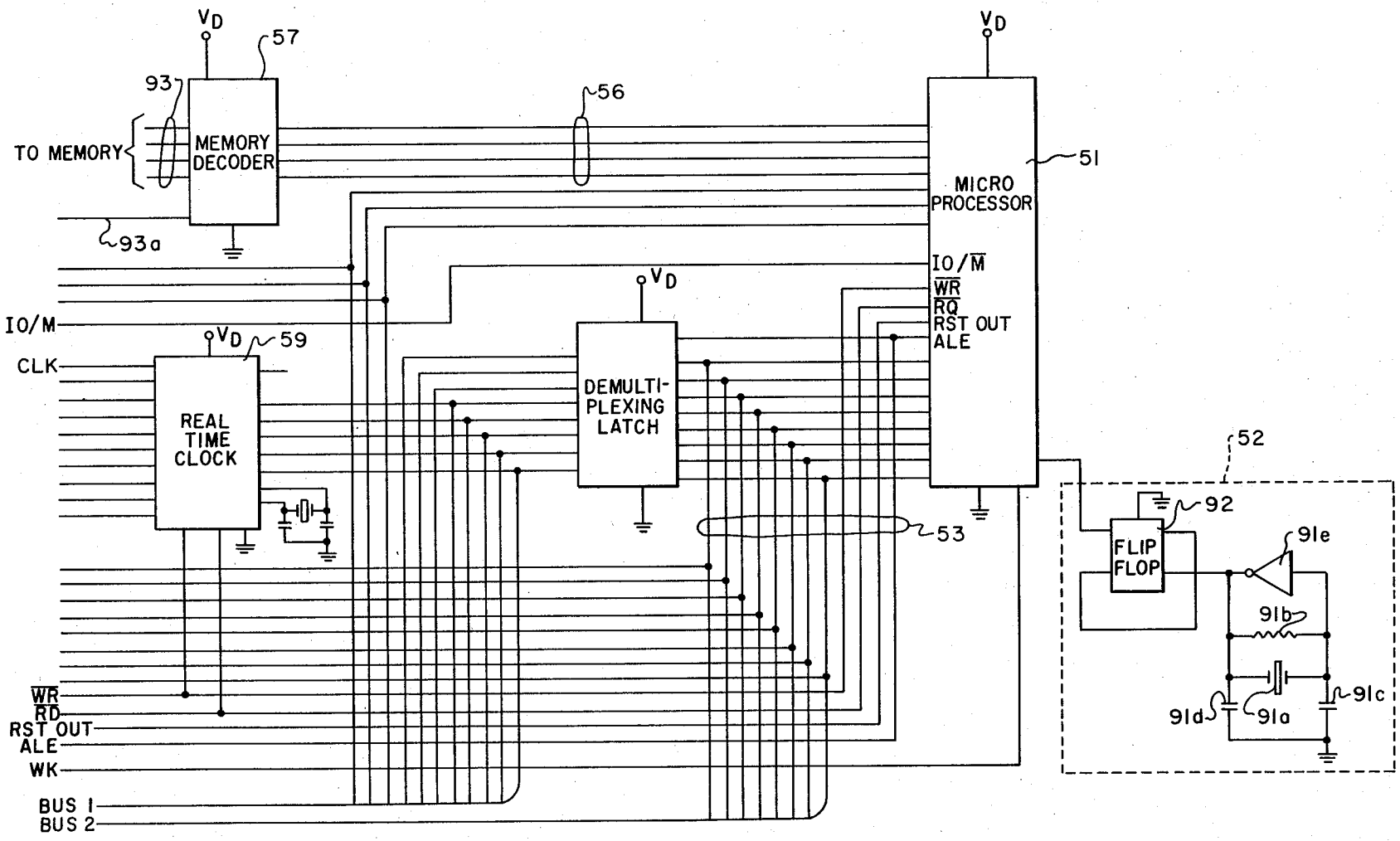
Figure 7C:
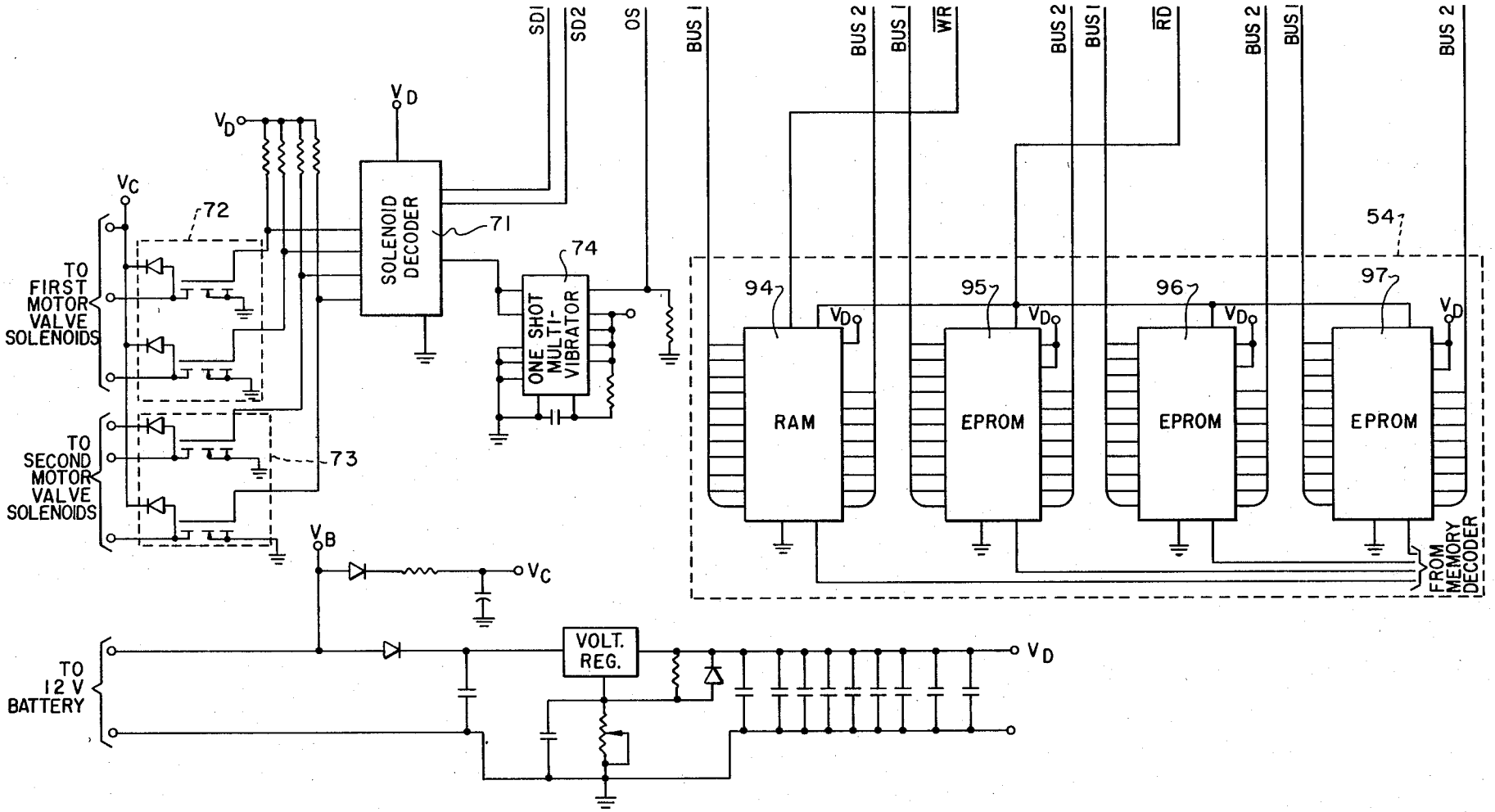
Figure 8A:
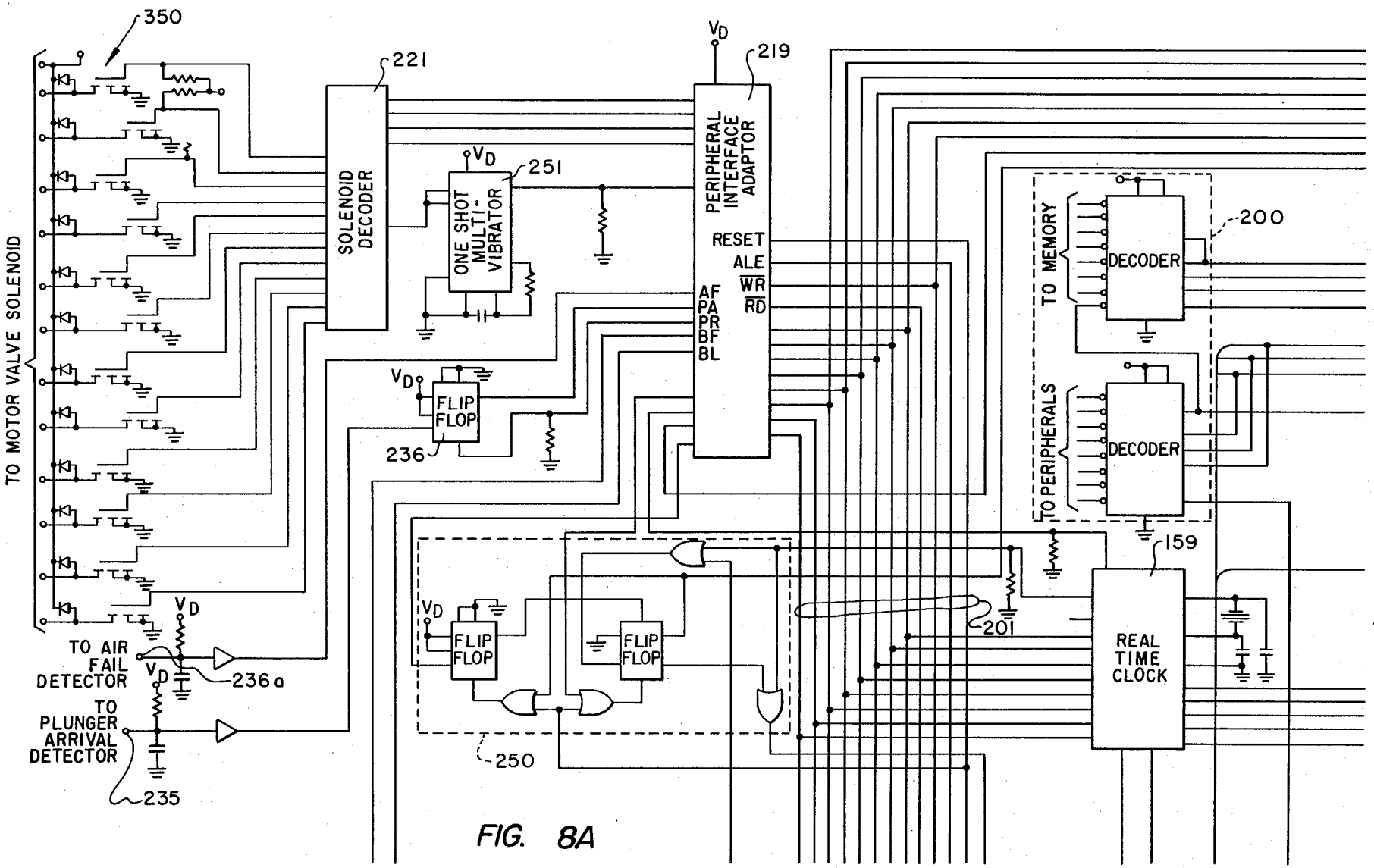
FIGS. 8A, 8B, 8C and 8D are each portions of a schematic diagram of an electronic controller constructed in accordance with the present invention and shown in FIG. 6.
Figure 8B:
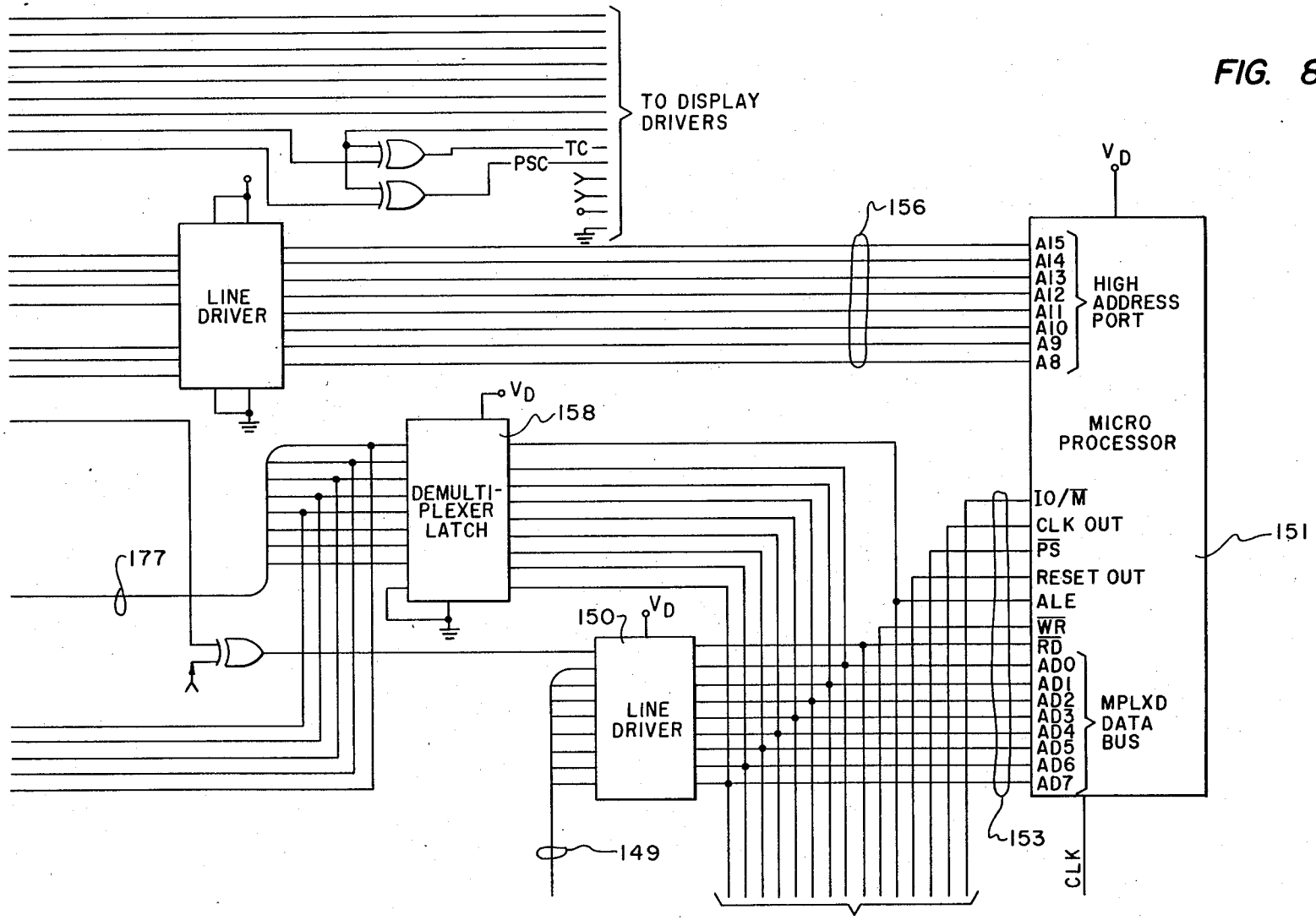
Figure 8C:
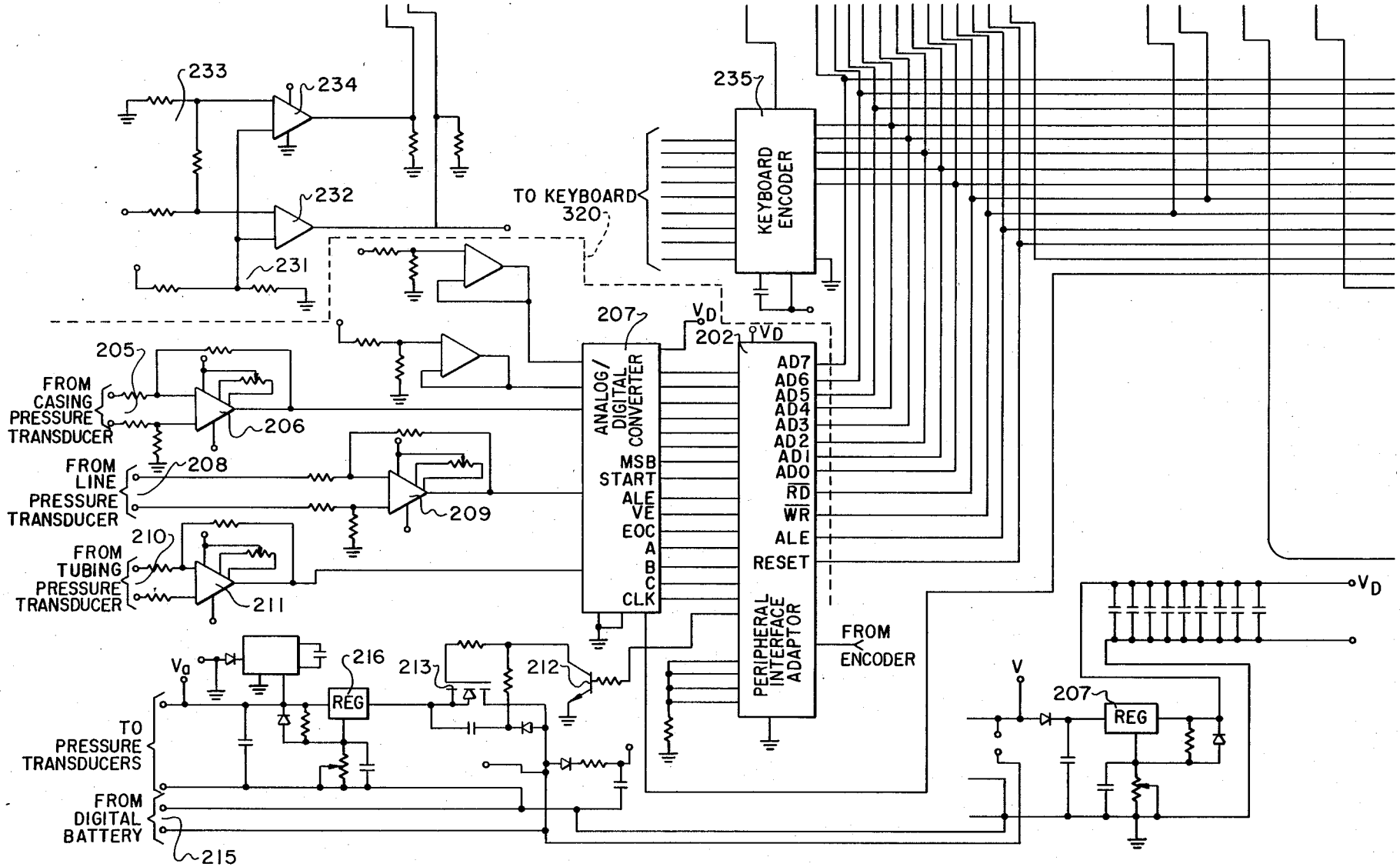
Figure 8D:
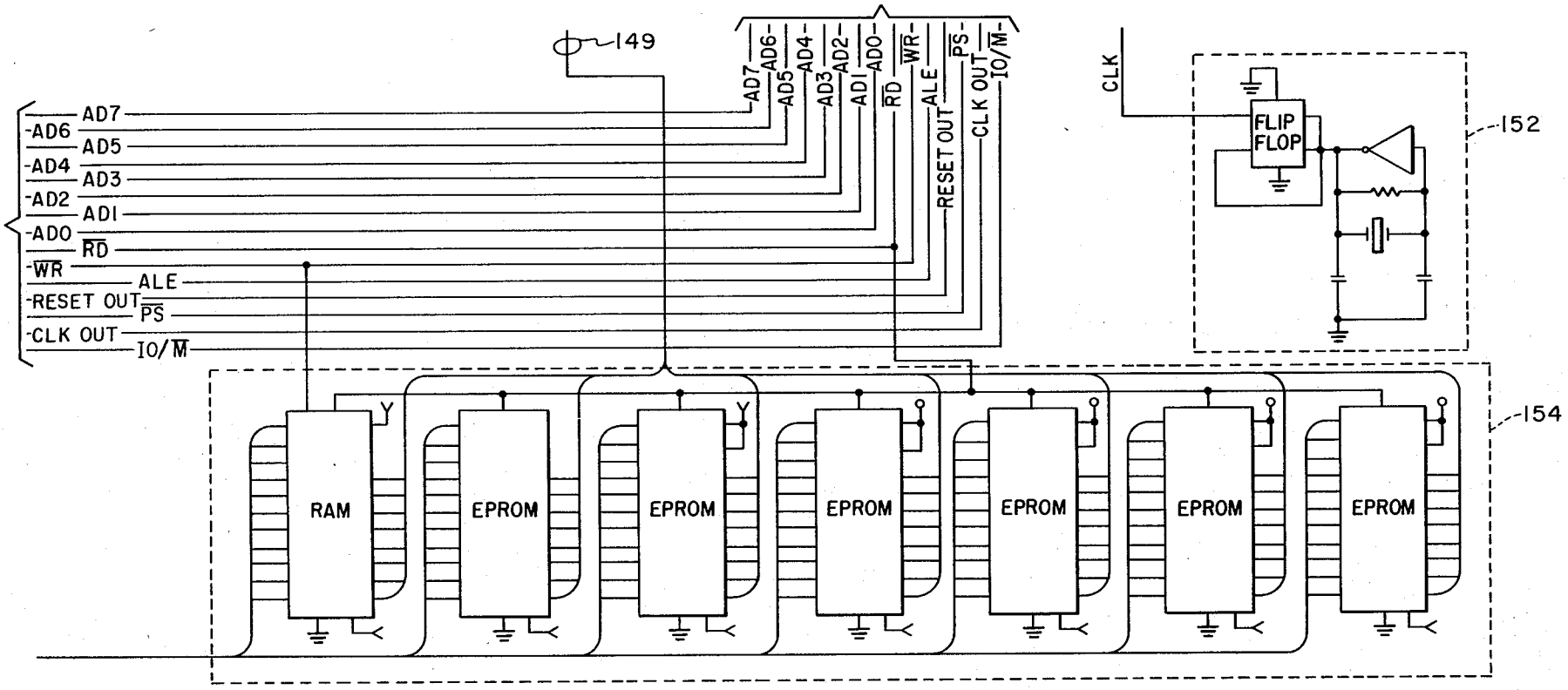

Referring next to the schematic diagram shown in FIGS. 7A, 7B and 7C, arranged for viewing as shown therein, the micro-processor 51 is connected to be driven by a 500 $KH_z$ clock driver 52 comprising an oscillator 91 connected through a flip-flop circuit 92. The oscillator 91 includes a 1 $MH_z$ crystal 91*a* across which is connected a resistor 91*b*, a pair of series-connected capacitors 91*c* and 91*d* and an inverting amplifier 91*e*. The micro-processor 51 is connected to the memory decoder 57 by leads comprising the address bus 56. The output of the memory decoder 57 is connected to the memory 54 by address leads 93 and connected to the peripheral decoder 58 by a single lead 93*a*. The output of the micro-processor 51 is also connected by means of a data and address bus 53 to a number of other components including the memory 54, the real time clock 59, the display drivers 81 and 82 (FIG. 5), as well as the keyboard encoder 76 and the peripheral interface adapter 61. A memory decoding latch 57 is provided to demultiplex the data and address buses from the output of the micro-processor 51. The memory 54 includes a RAM memory 94 for the storage of measured parameters and keyboard selectable programmed data, as well as a plurality of EPROM'S 95, 96, and 97 for the storage of program control for the micro-processor 51. The keyboard encoder 76 is connected to the keyboard 75 (FIG. 5) to input data from the keyboard into both the memory 54 as well as the optical display 83 for observation by the operator. The output of the peripheral interface adapter 61 is connected to both a solenoid decoder 71 as well as through a one-shot multi-vibrator 74 to energize the solenoids for a pre-selected time period. A pair of solenoid driver circuits 72 and 73 are connected to "on" and "off" solenoids for each of the two motor valves.

A plurality of external inputs are connected to the input of the peripheral interface adapter 61. A signal from a plunger arrival switch is connected through an inverter 62 and a flip-flop and 60 to provide a plunger arrival signal when the plunger has reached the top position in the tubing. An "on time" is pre-programmed into the controller so that if the plunger does not arrive to cause a plunger arrival signal by the time the "on time" has expired, the controller will automatically cycle and close the first valve and simultaneously open the second valve. After the passage of a pre-selected time period following a plunger arrival, a singal is placed on the plunger re-set lead PR which resets the flip-flop 60 and enables it to receive a new plunger arrival signal to the next cycle. An air pressure fail signal is also coupled through an inverter 63 to an input of the PIA 61 while high pressure and low pressure transducers are connected as inputs to the PIA and, respectively, provide indications that the tubing pressure is either above or below pre-selected values. In addition, a battery fail signal is coupled through an operational amplifier 98a and connected to the peripheral interface adapter as the BF lead while a battery low signal of a somewhat greater voltage than the fail is connected to the PIA through operational amplifier 98b as the BL lead.

As can be seen, the circuitry of FIGS. 7A, 7B and 7C serve to route signals to and from the micro-processor and the various peripheral components through the peripheral interface adapter to effect operation as set forth above in connection with FIGS. 1 and 2.

The power save circuit 83 consists of a pair of interconnected flip-flops 83a and 83b having OR gates connected to each of their reset leads. An output from the keyboard encoder 76 through OR gate 99a is coupled to the first flip-flop 83a. An output from the real time clock is also connected via the CLK lead to the other input of OR gate 99a. An output from the set lead of flip-flop 83a is connected through another OR gate 99b back to the micro-processor as the WK lead. Output from the flip-flops 83a and 83b are connected through a pair of EXCLUSIVE OR gates 100a and 100b which are connected to drive the display. One of the gates 100a is connected to drive the time colon which flashes on and off while the unit is in operation while the other gate 100b is connected to a "power save" colon which burns steady when the system is in power save mode and indicates that minimum power is being consumed. In power save mode, all processor and analog functions are powered down except those necessary to maintain memory and essential digital operations to conserve power. In the event of a signal from either the keyboard decoder 76 or the real time clock 59, which produces a signal on the CLK lead every five seconds, is received through gate 99a, the power save circuit is switched out of power save mode and power is delivered to all of the components for operation and evaluation of the status of the system.

Multi-Controller Operation

Figure 3:
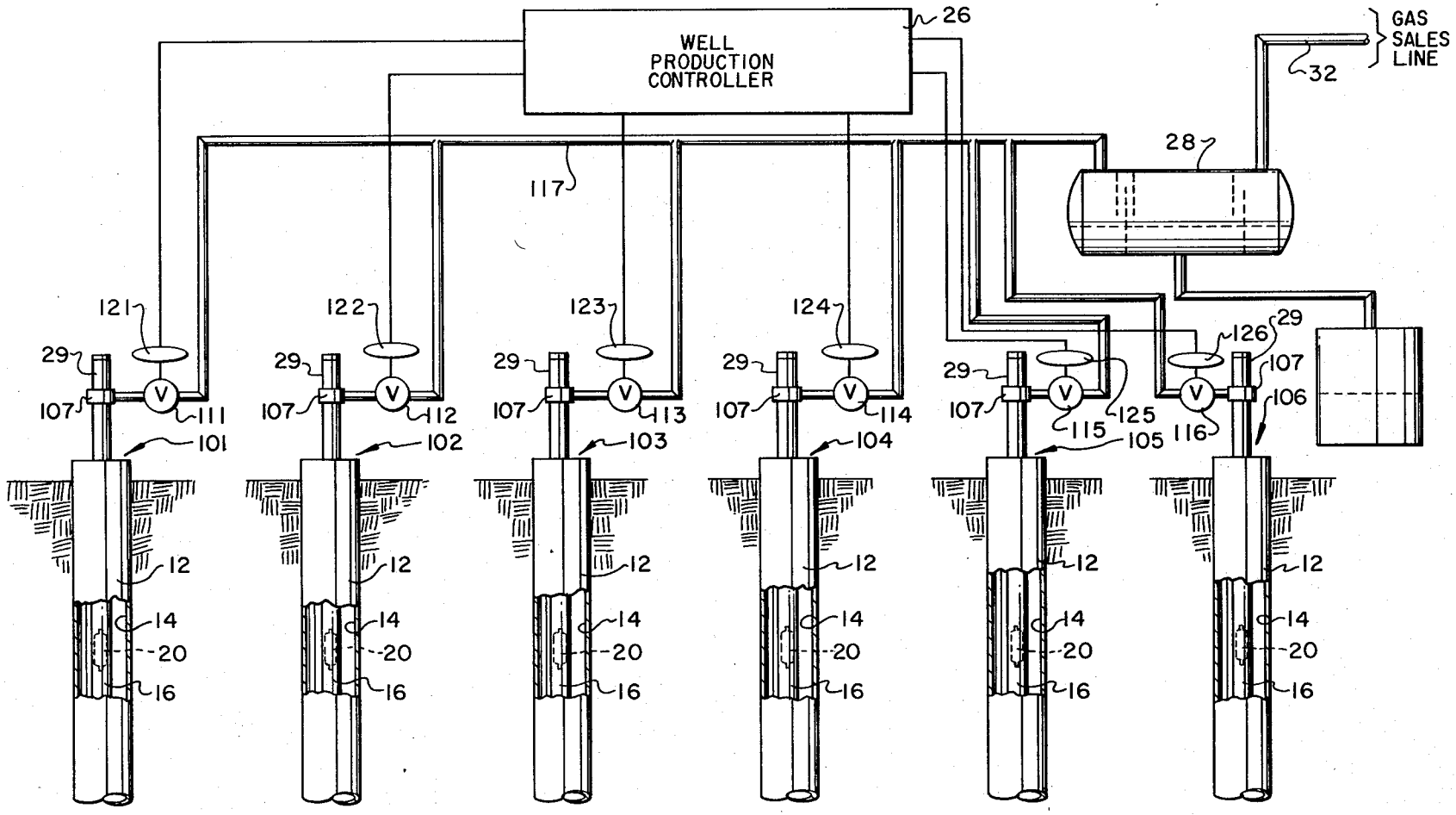
FIG. 3 is a schematic drawing of a plurality of sequentially operated production wells each having a single motor valve and including a programmable electronic controller constructed in accordance with the teachings of the invention.

Referring now to FIG. 3, there is shown a schematic drawing of a plurality of plunger lift well completions 101–106 similar to that shown in FIG. 2 and which are all controlled by a well production controller 26 constructed in accordance with the teachings of the present invention. Each of these wells may illustratively include a borehole 12 extending from the surface of the earth down to a producing geological formation which is lined with a tubular casing 14 which is perforated in a region adjacent the producing formation. The well also includes a string of tubing 16 connected from the region adjacent the perforations to the surface and which extends out through the top of the casing through a flow "T" 107 and a lubricator 29. The lower end of the tubing is terminated by a tubing stop and a bumper spring and a plunger 20 is mounted for reciprocation within the tubing. Each of the wells completions 101–106 may be essentially identical for illustrative purposes, and the output of each flow "T" 107 is connected, respectively, through a one of a plurality of motor valves 111–116 to a common manifold 117 connected to a separator 28 and a gas sales line 32. Each of the motor valves 111–116 are actuated by a pair of solenoids 121–126, respectively, which are connected for operation to the well production controller 26.

Due to the expense of providing supply gas and/or compressor capacity in remote locations, it is frequently desirable to operate only one of a plurality of wells at a particular time period. The controller of the present invention 26 serves to sequence a multiple of wells between an "on" and an "off" state, each of a preselected time period of "on" time and "off" time in an orderly fashion. That is, by entering the "on" time and "off" time for each of the plurality of wells in the array, the controller will perform an orderly "queing" function to turn the wells on in sequence in accordance with the sequential order in which the wells each reach an expiration of their "off" time.

Figure 6:
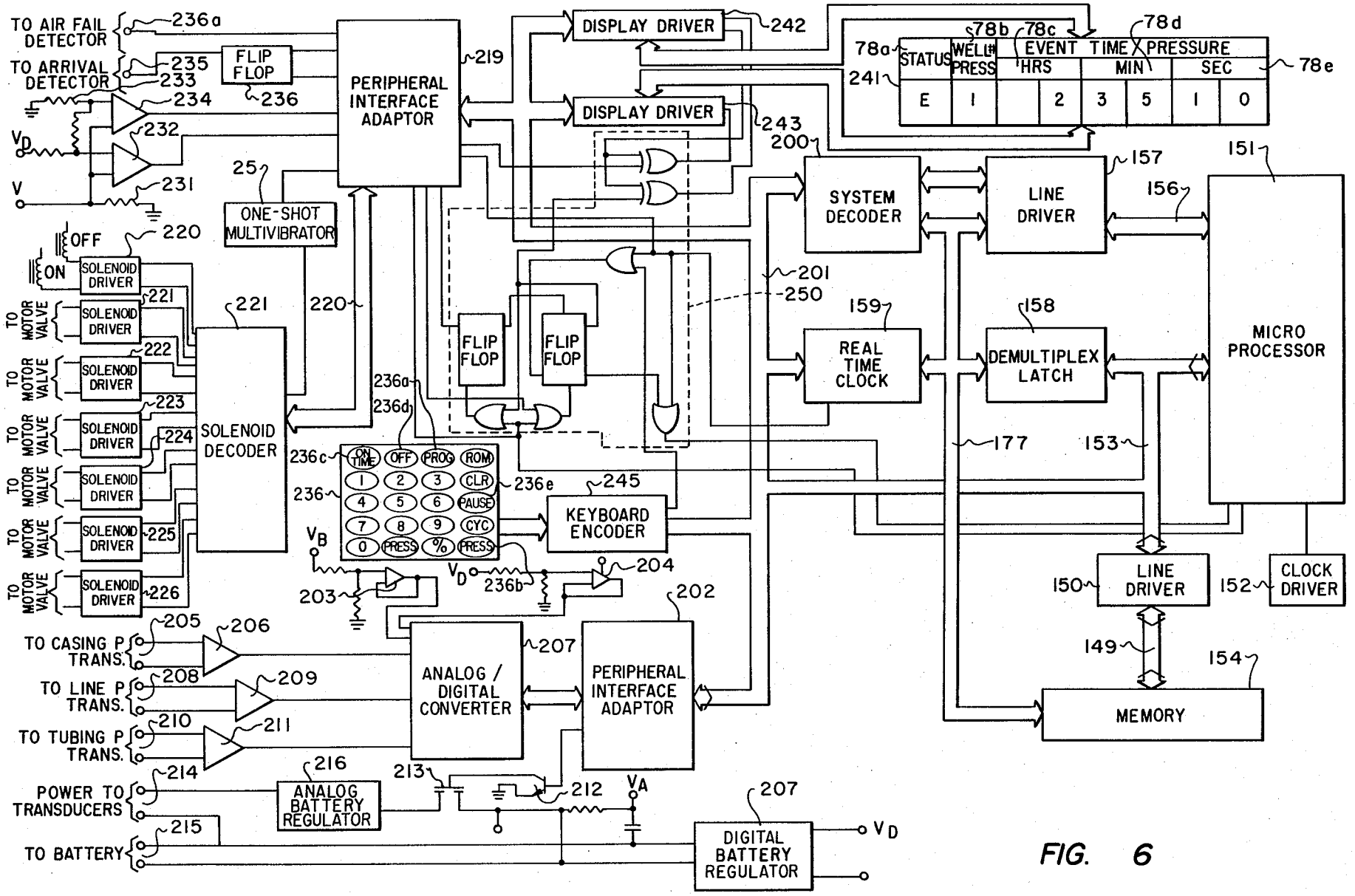
FIG. 6 is a block diagram of an electronic controller used in conjunction with the systems shown in FIGS. 1 and 2.

Referring to FIG. 6, the LCD display is similar to the display 78 of FIG. 5, with alphabetical characters H, E, L and P to indicate both alarm conditions and circuit status, and numeral characters to indicate times. The status portion 78a indicates the condition of the cycle of operation of the circuit as either ON TIME-P or OFF TIME-E while the remaining time is decremented in hours, minutes and seconds in display sections 78c, 78d and 78e, respectively. The well number being operated by the controller is shown in section 78b.

The system is programmed in the multi-well configuration as follows. First, the PAUSE key 236e is pressed to stop the operation of the circuit in whatever state it is in. Next, the PROGRAM key 236a is pressed followed by the WELL NUMBER key 236b and a numeral to indicate the particular well. Thereafter, a time key such as ON TIME key 236c is depressed followed by numeral keys to program the time into the memory. Each time period programmed requires the full sequence to be repeated, namely, PROGRAM, WELL NUMBER, numerals to select the well, ON TIME or OFF TIME keys and numerals to select the time. The sequence is repeated until all on times and off times for all wells has been entered into the memory.

The operation of the controller 26 in conjunction with the multiple well configuration of FIG. 3 will be explained in further detail below.

Optimizing Controller Operation

Figure 4:
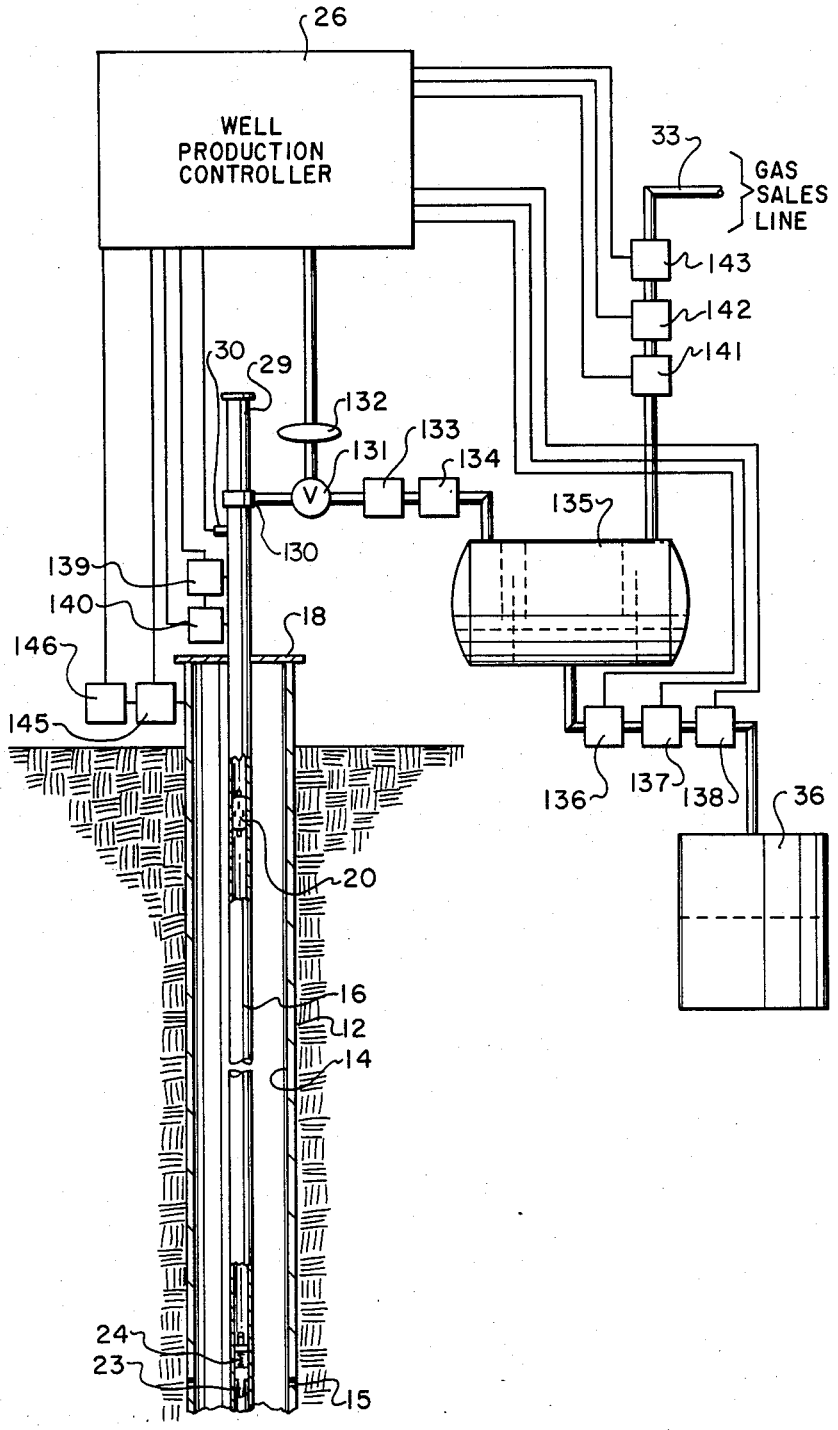
FIG. 4 is a schematic drawing of a plunger lift well completion wherein the well is operated in accordance with various measured parameters and including a programmable electronic controller constructed in accordance with the invention.

Referring now to FIG. 4, there is shown an illustrative schematic drawing of a plunger lift oil well completion similar to those of FIGS. 2 and 3, wherein the well is operated in accordance with various measured parameters by a well production controller 26. The well includes a borehole 12 extending from the surface of the earth and having a tubular casing 14 extending from the surface down to the producing formation at which perforations 15 are formed to allow the passage of fluids and gases from the formation into the casing 14. The well also includes a string of tubing 16 which is terminated at the lower end by a tubing stop 23 and a bumper spring 24. A reciprocating plunger 20 is mounted for movement in a vertical direction up and down the tubing 16. The upper end of the casing is closed at a wellhead 18 and has protruding therefrom a section of the tubing which includes a lubricator 29 to receive the plunger 20 when it is in its uppermost position. In addition, a plunger arrival sensor 30 is provided to indicate when the plunger is in its uppermost position. The upper end of the tubing includes a flow "T" 130, the output of which is connected through a motor valve 131 operated through solenoids 132 by the well production controller 26.

The output flow line from the motor valve 131 passes through a temperature flow and pressure sensors 133 and 134 into a separator 135. Actual tubing pressure and temperature are monitored through transducers 139 and 140 while transducers 145 and 146 monitor casing pressure and temperature. The liquid flow from the separator also has temperature, pressure and flow rate monitored by sensors 136–138, respectively, into a storage tank 36. The gas flow from the separator 135 flows through temperature, pressure, and flow rate sensors 141, 142, and 143, into the gas sales line 32. The output of each of the temperature, pressure, and flow rate sensors are connected to the well production controller 26 and each supplies a measured value thereto when the transducer is energized by the controller. It should be clear that in other aspects of the invention, the well parameter monitoring transducers 133, 134, and 136–146 could be selected to measure other desired parameters, e.g., oil/water ratio and supply that information to the controller 26 for use operating the well or wells.

Based upon established principles of reservoir engineering, there are certain pressure/flow relationships in a well completion which relate to optimum production from the well. For example, it has been determined that by calculation of the Ideal Tubing Prressure from established relationships for a well, an operator can compare the Acutal Tubing Pressure of that well just before the well is opened and adjust a conventional intermitted timing cycle to achieve optimum production from the well. That is, by flowing tube well for a longer period (or shutting it in for a shorter period), if the actual tubing pressure is greater than the calculated ideal pressure and by flowing the well for a shorter period (or shutting it in for a longer period), production levels near optimum can be achieved.

However, the pressure/flow relationships in a well change with time and may vary substantially for a particular well between visits by an operator to adjust the timing cycles. The controller of the present invention includes the capability of regularly, cyclically measuring the various flow/pressure/temperature parameter of one or more wells and controlling the operation based directly upon the use of the monitored values in algorithms pre-programmed into the processor and the result of the processor's calculations and decisions. This enables direct, continuous operation of a well to achieve optimum production from an individual well or an entire field of wells based upon actual operating conditions.

Purely, by way of example, in illustrating the use of the well controller of the present invention shown in FIG. 4, a NET PRESSURE can be determined for a particular well by means of the following relationship:

$$\text{CASING PRESSURE} - \text{AVERAGE FLOWING SEPARATOR PRESSURE} = \text{NET PRESSURE}$$

For each well, there are numerous factors which determine the rate at which a plunger completion will cycle, such as depth of the well, gas/fluid ratio, gas gradiant, fluid gradiant and casing and tubing sizes. That is, a particular well will build up pressure from the reservoir sufficient to move the plunger to the surface and remove a load of fluid at a characteristic rate and there is some percentage of the net pressure at which the well will cycle over without a risk of the plunger getting stuck in the middle. A FACTOR as some two digit fraction of the NET PRESSURE is experimentally determined and programmed into the system.

A MAXIMUM FLUID PRESSURE is next determined:

$$\text{NET PRESSURE} \times \text{FACTOR} = \text{MAXIMUM FLUID PRESSURE}$$

and $$\text{IDEAL TUBING PRESSURE} = \text{CASING PRESSURE} - \text{MAXIMUM FLUID PRESSURE}$$

Thus, the controller periodically energizes transducers to measure the various parameters necessary to determine an IDEAL TUBING PRESSURE and the SALES LINE PRESSURE.

If the sales line pressure is less than the ideal tubing pressure, then the well should be opened for flow, if not the well should be shut-in. The well production controller 26 of the invention in the embodiment shown in FIG. 4 monitors the casing pressure by means of transducer 145, the flowing separator pressure by means of transducer 142, and the tubing pressure through transducer 139. The factor is established for a particular well based upon the ability of the well to lift a column of fluid and as a function of the gas/liquid ratio and programmed into the controller memory. The well production controller 26 calculates the ideal tubing pressure in accordance with the aforesaid algorithms and compares it to the sales line pressure measured at transducer 142 and, in the event the ideal pressure rises above the sales line value, the motor valve 131 is actuated through solenoids 132 to open the well and permit production flow therefrom.

Referring now to FIG. 6, there is shown a block diagram of a system constructed in accordance with the invention for the operation of the well control system shown in FIGS. 3 and 4. In particular, the system includes a micro-processor 151 driven by a clock driver 152 which is connected to a line driver 157 by means of an address bus 156. The micro-processor 151 is also connected by means of a data and address bus 153 through a line driver 150 to a memory 154. In addition, the micro-processor 151 is connected to a demultiplexing latch 158, the output of which is connected to the memory 154 via the bus 177 as well as to the real time clock 159 and a system decoder 200. A bus system 201 connects the system decoder and the real time clock to a peripheral interface adapter 202, having a plurality of inputs.

A low voltage detecting network is connected to the input of an operational amplifier 203 which provides a low analog battery voltage signal to the input of the peripheral interface adapter 202 while a low voltage condition from the digital battery is connected through an operational amplifier 204 to provide an indication to the peripheral interface adapter.

An output from a casing pressure transducer is connected from terminals 205 through an operational amplifier 206 and an analog digital converter 207 to the peripheral interface adapter 202. Similarly, an input from terminals 208 from which is connected a flow line pressure transducer is connected through an operational amplifier 209 and the A to D converter to the input of the peripheral interface adapter 202. In addition, the output of a tubing pressure transducer is connected from terminals 210 through the operational amplifier 211, and the A to D converter to the input of the peripheral interface adapter 202, provide substantive measurements of the precise values of casing, flow line, and tubing pressures any time these transducers are energized. The casing pressure, flowing line pressure, and tubing pressure transducers connected to terminals 205, 208, 210 and 214 may be transducers 145, 134 and 139, respectively, of FIG. 4. An output from the peripheral interface adapter 202 is connected through a switching transistor 212, a field effect transistor 213 and an analog battery regulator 216 to supply voltage to the transducers over terminals 214 to power the transducers and produce an output reading indicative of the respective pressures. Input from a "digital" battery is provided to leads 215 which are connected to a digital battery regulator 217, the output of which powers all of the digital components necessary to retain memory and continue regular operation. A separate analog battery is provided for powering the analog components such as the pressure transducers and is operated through a power save circuit which will be more fully explained below.

A second peripheral interface adapter 219 is provided and the output of which is connected through a bus 220 to a solenoid decoder 221 connected to actuate one of a plurality of solenoid drivers 221–226 which control the plurality of motor valves in the multiple well embodiment of FIG. 3. A low digital battery voltage detection network 231 is connected through an operational amplifier 232 to the input of the peripheral interface adapter 219 while a dead battery detection network 233 is connected through an operational amplifier 234 to another input of the peripheral interface adapter 219. A plunger arrival terminal 235 is connected to a plunger arrival detector (FIG. 4) and provides a signal through flip-flop 236 to indicate the arrival of a plunger at the upper portion of the tubing to the peripheral interface adapter 219. An air pressure failure detector is connected to terminal 236 and provides a signal to the peripheral interface adapter 219 in the event of a failure of the compressed air supply used to operate the motor valves.

A multi-character liquid crystal display 241 is provided with a pair of display drivers 242 and 243. A bus system 201 interconnects the display drivers 242 and 243 to a keyboard encoder 245 which decodes a keyboard 236 to display information encoded by the keyboard into the memory 154. Further, the optical display 241 may be utilized to observe various items of memory such as previously programmed times as well as various values of measured parameters within the system and the current operating status of the controller. The components within the power save circuit 250 which are adapted to reduce the power consumption of the controller during most of the time operation of the system. That is, the power save circuitry 250 operates to power down all of the non-essential functions which consume power until a signal is received either from the real time clock on a periodic basis or from a keyboard entry indicative that the system is being programmed or queried for information. Either of these two events serve to power up the system to make measurements and see if any action needs to be taken.

It can be readily seen how the controller system of FIG. 6 serves to operate the multiple well production control system of FIG. 3. The pause key **236*e* is actuated to stop operation of the controller. Next, a code is entered via keyboard 236 to indicate that the controller is to be used in the multiple well control configuration and then the PROGRAM key 236*a* pressed to prepare the controller to receive information. A WELL NUMBER key 236*b* and then numeral keys to select the well and an ON TIME key 236*c* or OFF TIME key 237*d* are used to assign a well number and "on" or "off" times for that well. The entire cycle is repeated for each time on each well. A location within memory 154 is allotted to provide for the reception of keyed in number and time information for each of the motor valves 111–116 of the six wells 101–106 controlled by solenoid drivers 221–226. Each well is given a number designation and, thereafter, an "on" time and an "off" time is keyed into the memory to be associated with each well. In addition, a location within the memory 154 is allotted for storage of which particular wells have timed down to complete their "off times" and in what sequence they timed down and were then ready to be intermitted into the "on" state. Thus, only one of the well motor valves 111–116 is actuated at a time but each time that one of the wells 101–106 "off time" has expired, it will be then placed in a sequential que with the other wells ready to flow in the order in which their "off times" were over. Motor valves 111–116 are sequentially driven to the "on" state to open a well in accordance with the well's position in the que as determined by the micro-processor 151**.

It can also be readily seen how the controller system of FIG. 6 serves to operate the optimizing production control system of FIG. 4. Casing, flowing line and tubing pressures are measured by transducers which are periodically energized by means of power on terminals 214 to produce measured value indications on terminals 205, 208, and 210 which are passed through the operational amplifiers 206, 209, and 211, the analog to digital converter 207, and the peripheral interface adapter 202 to the microprocessor 151. With each measurement, the microprocessor 151 determines an ideal tubing pressure in accordance with the exemplary algorithm set forth above. In the event that the calculations based upon these measured values exceeds the measured tubing sales line pressure, the solenoid driver 220 of motor valve 131 (FIG. 4) is driven to the "off" state. If the sales line pressure is greater than the ideal pressure, a signal is given by the microprocessor 151 to open the motor valve 131 by means of solenoid driver 220.

It can be seen how from the illustration on optimizing well completion of FIG. 4 and the circuitry of FIG. 5, that as the sophistication of reservoir engineering increases to be able to quantify the relationship between one or more of various wells, algorithms can be written with which data can be evaluated and a decision made as to which of one or more wells should be placed in what state in order to achieve optimum production from the plurality of wells.

Referring now to FIGS. 8A–8D, there is shown a schematic diagram of the system illustrated in block form in FIG. 6. As can be seen, a clock driver 152 drives a microprocessor 151 preferably of the CMOS type. Output from the microprocessor 151 on the address bus 156 is provided to the line driver 157 and multiplexed data both into and out of the microprocessor 151 flows over the data bus 153. A line driver is provided at 150 to move information into and out of the memory 154 which consists of a RAM together with a plurality of EPOM storage units. A demultiplexing latch 158 is provided on the data bus to demultiplex the output from the microprocessor 151. The latch 158 is connected to the real time clock 159 via bus 177 as well as the memory 154 and the total system decoder 200. Outputs from the system decoder 200 go both the memory 154 as well as to each of the peripherals. The multiplex data bus 201 carries data address and control information among each of the peripheral units such as the real time clock 159, the keyboard incoder 235 as well as the first and second peripheral interface adapters 202 and 219.

The analog circuit for use in connection with the measuring of actual data in the configuration of FIG. 4 is contained in the analog circuit 320. This comprises terminals 205, 208, and 210 to receive signals from the casing line and tubing pressure transducers through the operational amplifiers 206, 209, and 211 which pass through an analog to digital converter 207 into the peripheral interface adapter 202. An input from the battery on terminals 215 is periodically passed through a field effect transistor 213 and an analog battery regulator 216 to energize terminal 214 and power each of the pressure transducers to receive a value reading therefrom.

A first operational amplifier 203 is connected to a voltage dividing network to measure low analog battery condition while a second operational amplifier 204 is connected to measure a dead analog battery condition and provide an indication through the analog/digital converter 307 to the peripheral interface adapter 302. Digital battery condition is measured by network 231 and differential amplifier 232 while dead digital battery condition is detected by network 233 and operational amplifier 234 into the peripheral interface adapter 219.

Solenoid driver circuits 350 are connected to the peripheral interface adapter 219 which drives through a one-shot multivibrator 251 and a solenoid decoder 221 to power a plurality of motor valve solenoid drivers 221–226. An air pressure failure signal on lead 236*a* provides an indication to the peripheral interface adapter 219 while a plunger arrival signal on terminal 235 provides an indication through the flip-flop 236 to the peripheral interface adapter 219. In particular, the circuitry operates to provide systematic operation of the well configuration shown in FIGS. 3 and 4.

In another aspect, the concepts of the present invention can be used to monitor well parameters and only allow production flow in the event the quality and quantity of output justified the quantity of injection gas required to produce that flow. For example, in an offshore field where a compressor of a given capacity is being used to sequentially supply inject gas to a plurality of gas injection completions, such as those shown in FIG. 1, it is desirable to utilize the compressor capacity in the most efficient manner. Thus, the broad concept of the present invention includes a controller for linking a plurality of wells and means for monitoring the volume of injection gas supplied to a well, the volume of production gas obtained, the volume and production fluid obtained and the percentage of oil/water mixture of production fluid and determining over a sample period whether or not the production flow obtained justified the quantity of inject gas necessary to obtain that flow. If not, the well is shut in and the inject gas capacity utilized to produce a different well where a greater production efficiency is present. The shut-in well is re-activated periodically and sampled again to reevaluate whether or not its production efficiency has increased to a point which would justify resumption of production. This approach optimizes the utilization of available production resources to obtain maximum return from a production field.

While particular embodiments of the invention have been described, it is obvious that changes and modifications may be made therein and still remain with the scope and spirit of the invention: It is the intent that the appended claims cover all such changes and modifications.

We claim:

1. A system for controlling the cyclic operation of a plurality of different petroleum production wells, each having a motor valve connected between the tubing and a flow sales line, comprising:
   - selectively programmable memory means;
   - means for storing in said memory a pair of signals associated with each one of said plurality of wells and which are indicative of a first time period during which the motor valve of that well should be open to permit production flow from the well and a second time period during which the motor valve of that well should be closed to shut in the well;
   - means responsive to the beginning of a cycle for opening the motor valve of the first well in the plurality of wells from which production flow is to be permitted and beginning the first time period of the first well and the second time period of all other wells;
   - means responsive to the sequential expiration of the second time periods of each of the other wells for storing in said memory means an indication of the sequence within which said second time periods expired; and
   - means responsive to the expiration of the first time period of each well having the motor valve open for simultaneously closing the motor valve of that well, beginning the second time period of that well, and opening the motor valve of the next well in sequence having had its second time period expire and beginning its first time period.

2. A system for controlling the cyclic operation of a plurality of different petroleum production wells as set forth in claim 1 wherein said means for storing includes:
   - a keyboard connected to said memory means and an optical display for selectively programming said memory with said time period values for each of said wells.

3. A system for controlling the cyclic operation of a plurality of different petroleum production wells as set forth in claim 2 wherein each of said motor valves are operated by supply of pressurized gas and which includes:
   - means responsive to the pressure of said supply gas being below a pre-selected value for closing all motor valves and providing a visual alarm in said optical display.

4. A system for controlling the cyclic operation of a plurality of different petroleum production wells as set forth in claim 1 wherein each of said wells is a plunger lift completion and includes:
   - a plunger mounted for reciprocating movement in the tubing of the well;
   - means for sensing when the plunger arrives at its uppermost position in the well tubing; and
   - means responsive to the failure of the plunger of a well to arrive at its uppermost position within a pre-selected fraction of that well's first time period for closing the motor valve of the well and opening the motor valve of the next well in sequence.

5. A system for controlling the cyclic operation of a plurality of different petroleum production wells as set forth in claim 1 which also includes:
   - means for measuring the tubing pressure of said wells;
   - means responsive to the tubing pressure of a well being greater than a pre-selected value during said first time period for extending the length thereof for production flow from a well;

means responsive to the tubing pressure of a well being less than a pre-selected value during said second time period for extending the length thereof and keeping the well shut in.

6. A system for controlling the cyclic operation of a plurality of different petroleum production wells as set forth in claim 1 wherein each of said means for opening and closing motor valves includes:

processor means;

peripheral interface adaptor means;

a pair of solenoids connected to operate each motor valve;

a solenoid decoder connected between said peripheral interface adaptor and said solenoids; and data bus means interconnecting said processor with said memory and said peripheral interface adaptor to permmit data flow therebetween and enable the processor to control the solenoids based upon time period information stored in the memory.

7. A system for controlling the cyclic operation of a plurality of different petroleum production wells as set forth in claim 1 wherein the system is battery powered and which also includes:

power save circuitry to power down all analog circuits and all digital functions other than timing and memory to conserve power;

a real time clock; and means responsive to regular periodic signals from the real time clock or a signal from said keyboard to disable said power save gating circuitry and supply full operating power to the system.

8. A system for controlling the cyclic operation of a plunger lift completion pertroleum producing well having a motor valve connected between the tubing of the well and a flow sales line, comprising:

memory means;

means for storing in said memory signals indicative of an algorithm for calculating the ideal tubing pressure for producing the well from well casing pressure, flowing separator pressure and a factor representative of the characteristic rate at which the well will cycle the plunger repeatedly;

means for measuring the casing pressure of the well;

means for measuring the flowing separator pressure of the well;

means for measuring the sales line pressure;

means for storing in said memory a signal indicative of the factor representative of the characteristic rate at which the well will cycle a plunger;

processor means for periodically receiving from the memory signals indicative of the algorithm and the factor and from said measuring means the measured pressure values and calculating an ideal tubing pressure value; and means for opening said motor valve when the ideal pressure value is greater than the sales line pressure and closing said motor valve when the ideal pressure value is less than the sales line pressure.

9. A system for controlling the cyclic operation of a plunger lift completion petroleum producing well as set forth in claim 8 wherein said means for storing includes:

a keyboard connected to said memory and an optical display for selectively programming said memory with said factor value and selectively measuring and observing pressure values.

10. A system for controlling the cyclic operation of a plunger lift completion petroleum producing well as set forth in claim 8 wherein said motor valve is operated by a supply of pressurized gas and which includes:

means responsive to the pressure of said supply gas being below a pre-selected value for closing said motor valve and providing a visual alarm in said optical display.

11. A system for controlling the cyclic operation of a plunger lift completion petroleum producing well as set forth in claim 8 which also includes:

peripheral interface adaptor means;

a pair of solenoids connected to operate the motor valve;

a solenoid decoder connected between said peripheral interface adaptor and said solenoids; and data bus means interconnecting the processor with the memory and said peripheral interface adaptor to permit data flow therebetween and enable the processor to control the solenoids based upon measured pressure values and calculations with the algorithm.

12. In a system for controlling the operation of a petroleum producing well having a motor valve connected between the output of the well and a production flow sales line, comprising:

selectively programmable memory means;

means for storing in said memory signals indicative of a set of criteria for governing the opening and closing of said motor valve of said well in response to conditions in the well in order to obtain optimum efficiency in production flow from the well;

means for periodically measuring physical parameters of said well;

processor means for performing calculations and evaluating the measured parameters of said well in accordance with the criteria stored in said memory means and opening and closing the motor valve in response to said evaluation to obtain optimum efficiency in production flow from the well into the production flow sales line.

13. In a system for controlling the operation of a petroleum producing well as set forth in claim 12 wherein:

said means for storing includes a keyboard and a keyboard encoder connected to said memory means and an optical display for selectively programming said memory means.

14. In a system for controlling the operation of a petroleum producing well as set forth in claim 13 wherein said set of criteria for governing the opening and closing of the motor valve includes algorithms which relates various measured well parameters to production flow.

15. In a system for controlling the operation of a petroleum producing well as set forth in claim 14 which also includes a second motor valve connected between a supply of pressurized gas and the well casing and wherein said measured well parameters include the quantity of injection gas required to produce a measured quantity of production petroleum and wherein said criteria include minimally acceptable values of production petroleum for given quantities of injection gas.

16. In a system for controlling the operation of a petroleum producing well as set forth in claim 15 wherein said measuring means includes:

means for measuring the percentage of oil and water mixture in the production flow.

17. In a system for controlling the operation of a plurality of petroleum producing wells each having a motor valve connected between the output of the well and a production flow sales line comprising:

selectively programmable memory means;

means for storing in said memory signals indicative of a set of criteria for governing the opening and closing of the motor valves of said wells in response to conditions in the wells in order to obtain optimum production flow from the plurality of wells;

means for periodically measuring physical parameters of each of said wells;

processor means for performing calculations and evaluating the measured parameters of said wells in accordance with the criteria stored in said memory means and selectively opening and closing the motor valves of said wells in response to said evaluation to obtain optimum production flow from the wells into the production flow sales line.

18. In a system for controlling the operation of a plurality of petroleum producing wells each having a motor valve connected between the output of the well and a production flow sales line as set forth in claim 17 wherein:

each of said wells is connected to a subterranean formation which is part of a reservoir common to all of the wells; and the set of criteria stored in said memory relates to the manner in which production flow from one of the wells affects production flow from the other wells in said plurality of wells.

19. In a system for controlling the operation of plurality of petroleum wells each having a motor valve connected between the output of the well and a production flow sales line as set forth in claim 17 wherein each of said petroleum producing wells also include a second motor valve connected between a supply of pressurized gas and the well casing and:

said measured well parameters include the quantity of injection gas required to produce a measured quantity of production petroleum; and said criteria include minimally acceptable values of production petroleum for given quantities of injection gas.

20. In a system for controlling the operation of a plurality of petroleum producing wells each having a motor valve connected between the output of the well and a production flow sales line as set forth in claim 19 wherein said measuring means includes:

means for measuring the percentage of oil and water mixture in the production flow from each well.

21. A method for controlling the cyclic operation of a plurality of different petroleum production wells, each having a motor valve connected between the tubing and a flow sales line, comprising:

storing in a selectively programmable memory a pair of signals associated with each one of said plurality of wells and which signals are indicative of a first time period during which the motor valve of that well should be open to permit production flow from the well and a second time period during which the motor valve of that well should be closed to shut in the well;

opening the motor valve of the first well in the plurality of wells from which production flow is to be permitted and beginning the first time period of the first well and the second time period of all other wells in response to the beginning of a cycle;

storing in said memory means an indication of the sequence within which said second time periods expire in response to the sequential expiration of the second time periods of each of the other wells; and simultaneously closing the motor valve of a well, beginning the second time period of that well and opening the motor valve of the next well in sequence having had its second time period expire and beginning its first time period all in response to the expiration of the first time period of each well having the motor valve open.

22. A method for controlling the cyclic operation of a plurality of different petroleum production wells as set forth in claim 21 wherein said storing step includes:

selectively programming said memory with said time period values for each of said wells connecting a keyboard to said memory means and an optical display.

23. A method for controlling the cyclic operation of a plurality of different petroleum production wells as set forth in claim 22 wherein each of said motor valves are operated by a supply of pressurized gas and which includes:

closing all motor valves and providing a visual alarm in said optical display in response to the pressure of said supply gas being below a pre-selected value.

24. A method for controlling the cyclic operation of a plurality of different petroleum producting wells as set forth in claim 21 wherein each of said wells is a plunger lift completion and which the method includes:

reciprocating a plunger mounted for movement in the tubing of the well;

sensing when the plunger arrives at its uppermost position in the well tubing; and closing the motor valve of the well and opening the motor valve of the next well in sequence in response to the failure of the plunger of a well to arrive at its uppermost position within a preselected fraction of that well's first time period.

25. A method for controlling the cyclic operation of a plurality of different petroleum production wells as set forth in claim 21 which also includes:

measuring the tubing pressure of said wells;

extending the length of the first time period for production flow from a well in response to the tubing pressure of a well being greater than a pre-selected value during said first time period;

extending the length of the second time period and keeping the well shut in in response to the tubing pressure of a well being less than a pre-selected value during said second time period.

26. A method for controlling the cyclic operation of a plurality of different petroleum production wells as set forth in claim 21 wherein the steps of opening and closing motor valves includes:

providing a processor means;

providing a peripheral interface adaptor means;

providing a pair of solenoids connected to operate each motor valve;

providing a solenoid decoder connected between said peripheral interface adaptor and said solenoids; and interconnecting said processor with said memory and said peripheral interface adaptor with data bus means and causing data flow therebetween to enable the processor to control the solenoids based upon time period information stored in the memory.

27. A method for controlling the cyclic operation of a plurality of different petroleum production wells as set forth in claim 21 wherein the method steps employ battery power and which method also includes:

providing power save circuitry to power down all analog circuits and all digital functions other than timing and memory to conserve power;

providing a real time clock; and disabling said power save gating circuitry and supplying full operating power to the system in response to regular periodic signals from the real time clock or a signal from said keyboard.

28. A method for controlling the cyclic operation of a plunger lift completion petroleum producing well having a motor valve connected between the tubing of the well and a flow sales line, comprising:

storing in a memory signal indicative of an algorithm for calculating the ideal tubing pressure for producing the well from well casing pressure, flowing separator pressure and a factor representative of the characteristic rate at which the well will cycle the plunger repeatedly;

measuring the casing pressure of the well;

measuring the flowing separator pressure of the well;

measuring the sales line pressure;

storing in said memory a signal indicative of the factor representative of the characteristic rate at which the well will cycle a plunger;

periodically receiving from the memory signals indicative of the algorithm and the factor and from said measuring means the measured pressure values into a processor means and calculating an ideal tubing pressure value; and opening said motor valve when the ideal pressure value is greater than the sales line pressure and closing said motor valve when the ideal pressure value is less than the sales line pressure.

29. A method for controlling the cyclic operation of a plunger lift completion petroleum producing well as set forth in claim 28 wherein said storing step includes:

connecting a keyboard to said memory and an optical display and selectively programming said memory with said factor value.

30. A method for controlling the cyclic operation of a plunger lift completion petroleum producing well as set forth in claim 29 wherein said motor valve is operated by a supply of pressurized gas and which method includes:

closing said motor valve and providing a visual alarm in said optical display in response to the pressure of said supply gas being below a pre-selected value.

31. A method for controlling the cyclic operation of a plunger lift completion petroleum producing well as set forth in claim 28 which method also includes:

providing a peripheral interface adaptor means;

providing a pair of solenoids connected to operate the motor valve;

providing a solenoid decoder connected between said peripheral interface adaptor and said solenoids; and interconnecting the processor with the memory and said peripheral interface adaptor with data bus means and causing data flow therebetween to enable the processor to control the solenoids based upon measured pressure values and calculations with the algorithm.

32. In a method for controlling the operation of a petroleum producing well having a motor valve connected between the output of the well and a production flow sales line, comprising:

storing in a selectively programmable memory a set of criteria for governing the opening and closing of said motor valve of said well in response to conditions in the well in order to obtain optimum efficiency in production flow from the well;

periodically measuring physical parameters of said well;

performing calculations and evaluating the measured parameters of said well in accordance with the criteria stored in said memory means in a processor means and opening and closing the motor valve in response to said evaluation to obtaim optimum efficiency in production flow from the well into the production flow sales line.

33. In a method for controlling the operation of a petroleum producing well as set forth in claim 32 wherein said storing step includes:

storing includes connecting of said memory means and an optical display for selectively programming said memory means.

34. In a method for controlling the operation of a petroleum producing well as set forth in claim 33 wherein said set of criteria for governing the opening and closing of the motor valve includes algorithms which relate various measured well parameters to production flow.

35. In a method for controlling the operation of a petroleum producing well as set forth in claim 33 which also includes a second motor valve connected between a supply of pressurized gas and the well casing and wherein said measured well parameters include the quantity of injection gas required to produce a measured quantity of production petroleum and wherein said criteria include minimally acceptable values of production petroleum for given quantities of injection gas.

36. In a method for controlling the operation of a petroleum producing well as set forth in claim 35 wherein said measuring step includes:

measuring the percentage of oil and water mixture in the production flow.

37. In a method for controlling the operation of a plurality of petroleum producing wells each having a motor valve connected between the output of the well and a production flow sales line comprising:

storing in a selectively programmable memory means a set of criteria for governing the opening and closing of the motor valves of said wells in response to conditions in the wells in order to obtain optimum production flow from the plurality of wells;

periodically measuring physical parameters of each of said wells;

performing calculations and evaluating the measured parameters of said wells in accordance with the criteria stored in said memory means in a processor means and selectively opening and closing the motor valves of said wells in response to said evaluation to obtaim optimum production flow from the wells into the production flow sales line.

38. In a method for controlling the operation of a plurality of petroleum producing wells each having a motor valve connected between the output of the well and a production flow sales line as set forth in claim 37, wherein:

each of said wells is connected to a subterranean formation which is part of a reservoir common to all of the wells; and the set of criteria stored in said memory relates the manner in which production flow from one of the wells affects production flow from the other wells in said plurality of wells.

39. In a method for controlling the operation of a plurality of petroleum producing wells each having a motor valve connected between the output of the well and a production flow sales line as set forth in claim 37, wherein each of said wells also have a second motor valve connected between a supply of pressurized gas and the well casing and:

said measured well parameters include the quantity of injection gas required to produce a measured quantity of production petroleum; and said criteria include minimally acceptable values of production petroleum for given quantities of injection gas.

40. In a method for controlling the operation of a plurality of petroleum producing wells each having a motor valve connected between the output of the well and a production flow sales line as set forth in claim 39 wherein said measuring step includes:

measuring the percentage of oil and water mixture in the production flow from each well.

* * * * *